US007958929B2

(12) United States Patent
Hasegawa et al.

(10) Patent No.: US 7,958,929 B2
(45) Date of Patent: Jun. 14, 2011

(54) APPARATUS FOR PRODUCING ALLOY AND RARE EARTH ELEMENT ALLOY

(75) Inventors: Hiroshi Hasegawa, Chichibu (JP); Kazuya Ueno, Chichibu (JP); Shinichi Osawa, Chichibu (JP); Shiro Sasaki, Chichibu (JP)

(73) Assignee: Showa Denko K.K., Tokyo (JP)

( * ) Notice: Subject to any disclaimer, the term of this patent is extended or adjusted under 35 U.S.C. 154(b) by 393 days.

(21) Appl. No.: 12/093,936

(22) PCT Filed: Apr. 6, 2007

(86) PCT No.: PCT/JP2007/058124

§ 371 (c)(1),
(2), (4) Date: May 15, 2008

(87) PCT Pub. No.: WO2007/117037

PCT Pub. Date: Oct. 18, 2007

(65) Prior Publication Data

US 2009/0095938 A1 Apr. 16, 2009

Related U.S. Application Data

(60) Provisional application No. 60/792,647, filed on Apr. 18, 2006.

(30) Foreign Application Priority Data

Apr. 7, 2006 (JP) ..... 2006-106793

(51) Int. Cl.
*B22D 11/12* (2006.01)
*B22D 45/00* (2006.01)

(52) U.S. Cl. ..... 164/269; 164/423

(58) Field of Classification Search ..... 164/417, 164/269, 412, 423, 463
See application file for complete search history.

(56) References Cited

U.S. PATENT DOCUMENTS

| | | | | |
|---|---|---|---|---|
| 5,908,513 | A | 6/1999 | Sasaki et al. | |
| 6,043,424 | A | 3/2000 | Horio et al. | |
| 6,291,031 | B1 | 9/2001 | Okazaki et al. | |
| 7,160,398 | B2 | 1/2007 | Kanekiyo | |
| 2005/0028892 | A1 | 2/2005 | Sasaki | |
| 2010/0202917 | A1 * | 8/2010 | Nakajima | 420/591 |

FOREIGN PATENT DOCUMENTS

| | | | |
|---|---|---|---|
| JP | 63-047301 | A | 2/1988 |
| JP | 63-47301 | A * | 2/1988 |
| JP | 05-222488 | A | 8/1993 |
| JP | 08-264363 | A | 10/1996 |

(Continued)

OTHER PUBLICATIONS

Chinese Office Action in CN-200780001424.8, dated Dec. 11, 2009.

(Continued)

*Primary Examiner* — Kevin P Kerns
(74) *Attorney, Agent, or Firm* — Sughrue Mion, PLLC

(57) ABSTRACT

An apparatus for producing an alloy, including: a casting device which casts a molten alloy using the strip cast method; a crushing device which crushes the cast alloy after casting; and a heating device which keeps the thin laminas of the cast alloy after crushing at a predetermined temperature or which heats the thin laminas of the cast alloy after crushing, wherein the heating device is equipped with a container and a heater.

18 Claims, 12 Drawing Sheets

FOREIGN PATENT DOCUMENTS

| | | | | |
|---|---|---|---|---|
| JP | 9-155507 | | * | 6/1997 |
| JP | 9-155507 | A | * | 6/1997 |
| JP | 09-155507 | A | | 6/1997 |
| JP | 10-36949 | A | | 2/1998 |
| JP | 11-213463 | A | | 8/1999 |
| JP | 2000-225460 | A | | 8/2000 |
| JP | 2001-250990 | A | | 9/2001 |
| JP | 2002-266006 | A | | 9/2002 |
| JP | 2003-013116 | A | | 1/2003 |
| JP | 2003-188006 | A | | 7/2003 |
| RU | 2255833 | C1 | | 7/2005 |
| WO | 02/072900 | A2 | | 9/2002 |

OTHER PUBLICATIONS

Russian Office Action in RU-2008120603, dated Dec. 15, 2009.

* cited by examiner

APPARATUS FOR PRODUCING ALLOY AND RARE EARTH ELEMENT ALLOY

This application claims the priority of Japanese Patent Application No. 2006-106793, filed Apr. 7, 2006, and the priority benefit of U.S. Provisional Application No. 60/792,647, filed on Apr. 18, 2006, the contents of which are incorporated herein by reference.

TECHNICAL FIELD

The present invention relates to an apparatus for producing an alloy. In particular, the present invention relates to an apparatus for producing a rare earth element-containing alloy that includes an R-T-B type alloy (wherein R is at least one or more elements of rare earth elements including Y, T is a metal which always includes Fe, and B is boron).

BACKGROUND ART

R-T-B type magnets, which have the highest magnetic energy product among permanent magnets, have been applied to hard disks (HD), MRIs (magnetic resonance imaging), various types of motors and the like due to their excellent properties. In recent years, their application for motors used in cars has been increased because energy saving is highly expected and the heat-resistance of the R-T-B type magnets has been improved.

The R-T-B type magnets mainly contain Nd, Fe, and B, and therefore, they are generally called an "Nd—Fe—B type" or "R-T-B type" magnet. The R of the R-T-B type magnet represents mainly those in which a part of Nd is substituted with other rare earth elements such as Pr, Dy, and Tb, namely at least one of these rare earth elements including Y T represents those in which a part of Fe is substituted with metals such as Co and Ni. B represents Boron in which a part of Boron can be substituted with C or N. In addition, Cu, Al, Ti, V, Cr, Ga, Mn, Nb, Ta, Mo, W, Ca, Sn, Zr, Hf, etc. may be added singularly or in combination as additional elements in the R-T-B type magnet.

An R-T-B type alloy, which turns into the R-T-B type magnet, is an alloy which has a main phase of $R_2T_{14}B$, namely a ferromagnetic phase that contributes to magnetization, and which simultaneously has non-magnetic R-rich phase having a low melting temperature in which the rare-earth elements are concentrated, and the R-T-B type alloy is an active metal. Therefore, the R-T-B type alloy has been molten or cast generally in a vacuum or an inert gas. Also, in order to produce a sintered magnet from a block of the cast R-T-B type alloy by way of the powdered metal technique, the block of the alloy is crushed into alloy powder of about 3 μm (measured using a Fisher Sub-Sieve Sizer (FSSS)), then pressed in a magnetic field, and sintered at a high temperature of about 1000° C. to 1100° C. in a sintering furnace. Then, the sintered alloy is generally subjected to the heating treatment, mechanical processing, and further plated to improve the erosion resistance, thereby forming a sintered magnet.

The R-rich phase of the R-T-B type sintered magnet has the following important roles:

1) The R-rich phase has a low melting temperature, becomes a liquid phase when sintered, and contributes to the densification of the magnet, namely the improvement of the magnetization;
2) The R-rich phase eliminates irregularities of the grain boundary, reduces nucleation sites in the reverse magnetic domain, and enhances the coercive force; and 3) The magnetic R-rich phase magnetically insulates the main phase, and increases the coercive force.

Consequently, if the state of the dispersion of the R-rich phases in the shaped magnet is inferior, this causes partial sintering-deficiency and low magnetization, and it is therefore important that the R-rich phases are uniformly dispersed in the shaped magnet. The distribution of the R-rich phases is considerably affected by the organization of the material, namely R-T-B type alloy.

Another problem rises in the casting of the R-T-B type alloy, in which α-Fe generates in the cast alloy. α-Fe has deformability, and therefore, is not crushed and remains in the crusher. This not only decreases the crushing efficiency of the alloy but also affects compositional alteration and the particle size distribution before and after crushing. Moreover, if α-Fe remains in the magnet even after sintering, then the magnetic property of the magnet will deteriorate. Therefore, it has been considered that α-Fe should be excluded from the material alloy as much as possible. This is why α-Fe has been eliminated in conventional alloys by subjecting them to homogenizing treatment conducted at a high temperature for an extended time where necessary. A small amount of α-Fe present in the material alloy can be eliminated by way of the homogenizing treatment. However, the elimination requires the solid phase dispersion at an extended period because α-Fe is present as peritectic nuclei. Consequently, the elimination of α-Fe is actually extremely difficult when the ingots have a thickness of several centimeters and the amount of the rare earth elements is 33% or less.

The strip cast method (abbreviated as "SC method") has been developed and applied to practical processes, in which a block of the alloy is cast at a more rapid cooling rate in order to solve the problem in which α-Fe generates in the R-T-B type alloy.

The SC method is a technique in which a thin lamina of about 0.1 mm to 1 mm is cast by pouring the molten alloy onto a copper roller whose inside is water-cooled, and the alloy is quenched and solidified. In the SC method, because the molten alloy is extensively cooled to the temperature at which an $R_2T_{14}B$ phase (main phase) generates, or below this temperature, the $R_2T_{14}B$ phase can be generated directly from the molten alloy and the deposition of α-Fe can be controlled. Furthermore, the crystalline organization of the alloy becomes refined by way of the SC method, and therefore, an alloy that has an organization where the R-rich phases are finely dispersed can be produced. The R-rich phase reacts with hydrogen in a hydrogen atmosphere, expands and becomes a fragile hydride. By applying this property, fine cracks are incorporated therein, matching the degree of the dispersion of the R-rich phases. When the alloy is finely crushed after such a hydrogenation process, a large number of the fine cracks generated by way of the hydrogenation causes the alloy to break, and the crushability is very excellent. Thus, as a thin lamina of the alloy cast by way of the SC method has internal R-rich phases finely dispersed therein, the dispersibility of the R-rich phases in the crushed and sintered magnet is also excellent, thereby successfully improving the magnetic property of the magnet (for example, patent document 1).

In addition, the thin lamina of the alloy cast by way of the SC method has excellent homogeneity of the organization. The homogeneity of the organization can be compared with respect to particle diameters of the crystals or the state of the dispersion of the Rich-phases. In the thin lamina of the alloy produced by way of the SC method, although chill crystals sometimes generate on the side of the thin lamina adjacent to the casting roller (hereinafter, referred as the "casting-roller side"), a properly refined and homogeneous organization on the whole, which resulted from the rapid-cooling and solidification, can be obtained.

As explained above, when the R-T-B type alloy cast by way of the SC method is applied to the production of a sintered magnet, the homogeneity of the R-rich phases in the produced magnet is enhanced, and the harmful effects to the crushing process and the magnetization owing to α-Fe can also be prevented. Thus, the block of the R-T-B type alloy cast by way of the SC method has an excellent organization for producing a sintered magnet. However, as the properties of the magnet improve, further improvement of the R-T-B type alloy has been sought.

Patent Document 1: Japanese Unexamined Patent Application, Publication No. H5-222488

DISCLOSURE OF INVENTION

As described above, the R-T-B type alloy is an alloy that mainly includes an element "R" in which a part of Nd is substituted with the other rare earth elements such as Pr, Dy and Tb; an element "T" in which a part of Fe is substituted with metals such as Co and Ni; and "B" (boron). In general, the heat-resistance of the R-T-B type magnet is evaluated on the basis of the magnitude of its coercive force. The coercive force increases as the compositional ratios of Dy and Tb in the R-T-B type alloy increase. However, Dy and Tb are very expensive metals. Therefore, there has been a problem in which the addition of Dy and Tb to produce an R-T-B type magnet is too costly.

Furthermore, the addition of Dy and Tb indeed improves the coercive force, but tends to decline the remanent magnetic flux density. This undesirably results in the decline of the hard magnetic characteristics.

The present invention was accomplished to solve the above problems. The object of the present invention is to provide an apparatus for producing a rare earth element-containing alloy, which makes it possible to produce a rare earth magnet that has a high coercive force.

In order to solve the above-described object, the present invention adopts the following:

[1] An apparatus for producing an alloy, including: a casting device which casts a molten alloy using the strip cast method; a crushing device which crushes the cast alloy after casting; and a heating device which keeps the thin laminas of the cast alloy after crushing at a predetermined temperature or which heats the thin laminas of the cast alloy, wherein the heating device is equipped with a container and a heater.

[2] The apparatus for producing an alloy according to [1], wherein a hopper and the heating device are disposed below the crushing device.

[3] The apparatus for producing an alloy according to [2], wherein the heater has an opening part, and an outlet of the hopper is disposed in the opening part.

[4] The apparatus for producing an alloy according to any one of [1] to [3], wherein the container is equipped with a storage container, and an opening-closing stage disposed over the storage container; the thin laminas of the cast alloy supplied from the crushing device are mounted on the opening-closing stage when the opening-closing stage is in a closed state; and the opening-closing stage releases the thin lamina of the cast alloy to the storage container when the opening-closing stage is in an opened state.

[5] The apparatus for producing an alloy according to [4], wherein the opening-closing stage releases the thin laminas of the cast alloy to the storage container after a predetermined period from the time when the thin laminas of the cast alloy are mounted on the opening-closing stage.

[6] The apparatus for producing an alloy according to any one of [1] to [5], wherein the heater keeps the thin laminas of the cast alloy mounted on the opening-closing stage at a predetermined temperature, or the heater heats the thin laminas of the cast alloy mounted on the opening-closing stage.

[7] The apparatus for producing an alloy according to any one of [1] to [6], further including a driving device which enables the container to move freely.

[8] The apparatus for producing an alloy according to [7], wherein the container is equipped with a plurality of the opening-closing stages, and the plurality of the opening-closing stages is disposed along the moving direction of the container.

[9] The apparatus for producing an alloy according to [8], wherein the thin laminas of the cast alloy are sequentially mounted on each opening-closing stage by moving the container in accordance with preparation of the thin laminas of the cast alloy.

[10] The apparatus for producing an alloy according to [8] or [9], wherein the opening-closing stages sequentially release the thin laminas of the cast alloy to the storage container after a predetermined period from the time when the thin laminas of the cast alloy are mounted on the opening-closing stages.

[11] The apparatus for producing an alloy according to any one of [4] to [10], wherein the opening-closing stage includes a stage plate, and an opening-closing system which opens and closes the stage plate while the opening-closing system controls the inclining angle of the stage plate; the opening-closing system mounts the thin laminas of the cast alloy on the stage plate by adjusting the stage plate at a horizontal position or a inclining position when the opening-closing stage is in a close state; and the opening-closing system releases the thin laminas of the cast alloy to the storage container by making the inclining angle of the stage plate larger when the opening-closing stage is in an open state.

[12] The apparatus for producing an alloy according to [11], wherein the opening-closing stage releases the thin laminas of the cast alloy to the storage container by making the inclining angle of the stage plate larger after a predetermined period from the time when the thin laminas of the cast alloy are mounted on the stage plate.

[13] The apparatus for producing an alloy according to any one of [7] to [12], wherein the heater is disposed between the crushing device and the opening-closing stages along the moving direction of the container.

[14] The apparatus for producing an alloy according to any one of [1] to [3], wherein a belt conveyor or a pushing device is disposed between the heater and the container.

[15] The apparatus for producing an alloy according to any one of [1] to [14], wherein the casting device, the crushing device and the heater are disposed inside a chamber of an inert gas atmosphere.

[16] The apparatus for producing an alloy according to [15], wherein a cooling chamber is provided inside the chamber, and the container is able to move to the cooling chamber.

[17] The apparatus for producing an alloy according to any one of [1] to [16], wherein the alloy is a rare earth element-containing alloy.

[18] The apparatus for producing an alloy according to [17], wherein the rare earth element-containing alloy includes an R-T-B type alloy where R is at least one element of rare earth elements including Y; T is a metal which indispensably contains Fe; and B is boron.

[19] The apparatus for producing an alloy according to any one of [1] to [16], wherein the alloy is a hydrogen absorbing alloy.

[20] The apparatus for producing an alloy according to any one of [1] to [16], wherein the alloy is a thermoelectric semiconductor alloy.

[21] An alloy which is produced with the apparatus for producing an alloy according to any one of [1] to [16].

[22] A rare earth element-containing alloy which is produced with the apparatus for producing an alloy according to any one of [1] to [16].

[23] A hydrogen absorbing alloy which is produced with the apparatus for producing an alloy according to any one of [1] to [16].

[24] A thermoelectric semiconductor alloy which is produced with the apparatus for producing an alloy according to any one of [1] to [16].

[25] A rare earth magnet, including the rare earth element alloy according to [22].

As described above, according to the apparatus for producing an alloy of the present invention, the thin laminas of the cast alloy after casting and crushing are subjected to the temperature-keeping treatment or the heating treatment, so that the properties of the alloy can be improved.

In particular, when the produced alloy is an R-T-B type alloy, its coercive force can be improved by way of the temperature-keeping treatment, and a rare earth magnet having excellent coercive force can be produced.

BEST MODE FOR CARRYING OUT THE INVENTION

Hereinafter, one preferred embodiment of the apparatus for producing an alloy of the present invention is explained by referring to the figures. However, it should be understood that the figures are used only for describing the configuration of the apparatus, and the shown size, width, scales, etc. of each device does not always reflects those of the actual apparatus for producing an alloy.

[Format of the Apparatus for Producing an Alloy]

Figure 1:
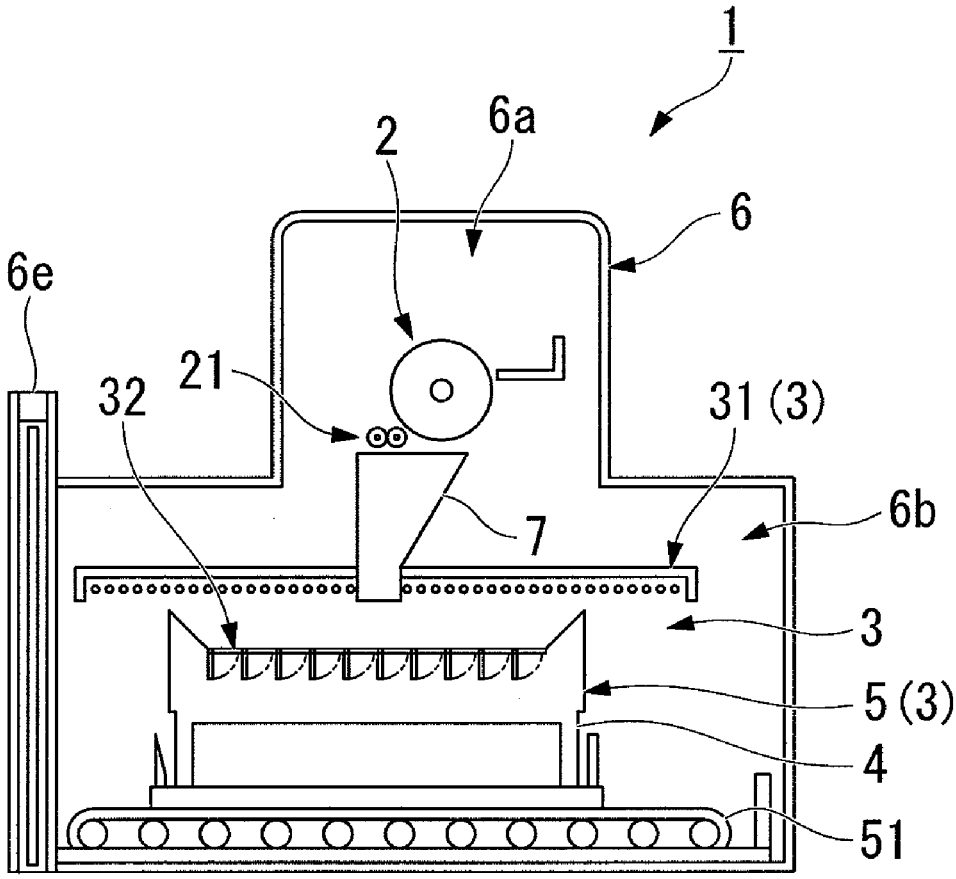
FIG. 1 is a front view showing one embodiment of the apparatus for producing an alloy in the present invention.

FIG. 1 is a front view showing a general configuration of the apparatus for producing an alloy as one embodiment.

An apparatus for producing an alloy 1 shown in FIG. 1 (hereinafter, shown as "production apparatus 1") is equipped with a casting device 2, a crushing device 21, and a heating device 3 in general. The heating device 3 includes a heater 31 and a container 5. The container 5 includes a storage container 4, and the opening-closing stage group 32 provided over the storage container 4. In this configuration, the container 5 (storage container 4) is disposed below the heating device 3. Also, the production apparatus 1 is equipped with a belt conveyor 51 (driving device) which freely actuates the container 5, and the container 5 can move to either the right or the left hand driven by the belt conveyor 51.

Also, the production apparatus 1 shown in FIG. 1 is equipped with a chamber 6. The chamber 6 includes a casting chamber **6*a* and a temperature-keeping storage chamber 6*b* which is provided below the casting chamber 6*a*, and which is connected to the casting chamber 6*a*. The casting device 2 is installed in the casting chamber 6*a*, and the heating device 3 is installed in the temperature-keeping storage chamber 6*b*. In this way, the casting device 2 and the heating device 3 are installed inside the chamber 6. In addition, the heating device 3 is disposed below the casting device 2** in this configuration.

A gate **6*e* is provided in the temperature-keeping storage chamber 6*b*, and the temperature-keeping storage chamber 6*b* is closed with the gate 6*e* except that the container 5 is conveyed outside the temperature-keeping storage chamber 6*b***.

The inside of the chamber 6 is in the state of reduced pressure of an inert gas, and examples of the inert gas include argon.

In addition, a cooling chamber may be provided on the side of the temperature-keeping storage chamber **6*b* across the gate 6*e*. Also, the cooling chamber may be equipped with another gate, and the container 5 may be designed to move outside the chamber 6** while leaving this gate open.

The casting device 2 is also equipped with the crushing device 21 that crushes blocks of the cast alloy formed by way of casting into thin laminas of the cast alloy. Moreover, a hopper 7 is provided between the casting device 2 and the opening-closing stage group 32. The hopper 7 directs the thin laminas of the cast alloy onto the opening-closing stage group 32.

Hereinafter, each of the devices included in the production apparatus 1 is further described in detail.

[Structure of the Casting Device]

Figure 2:
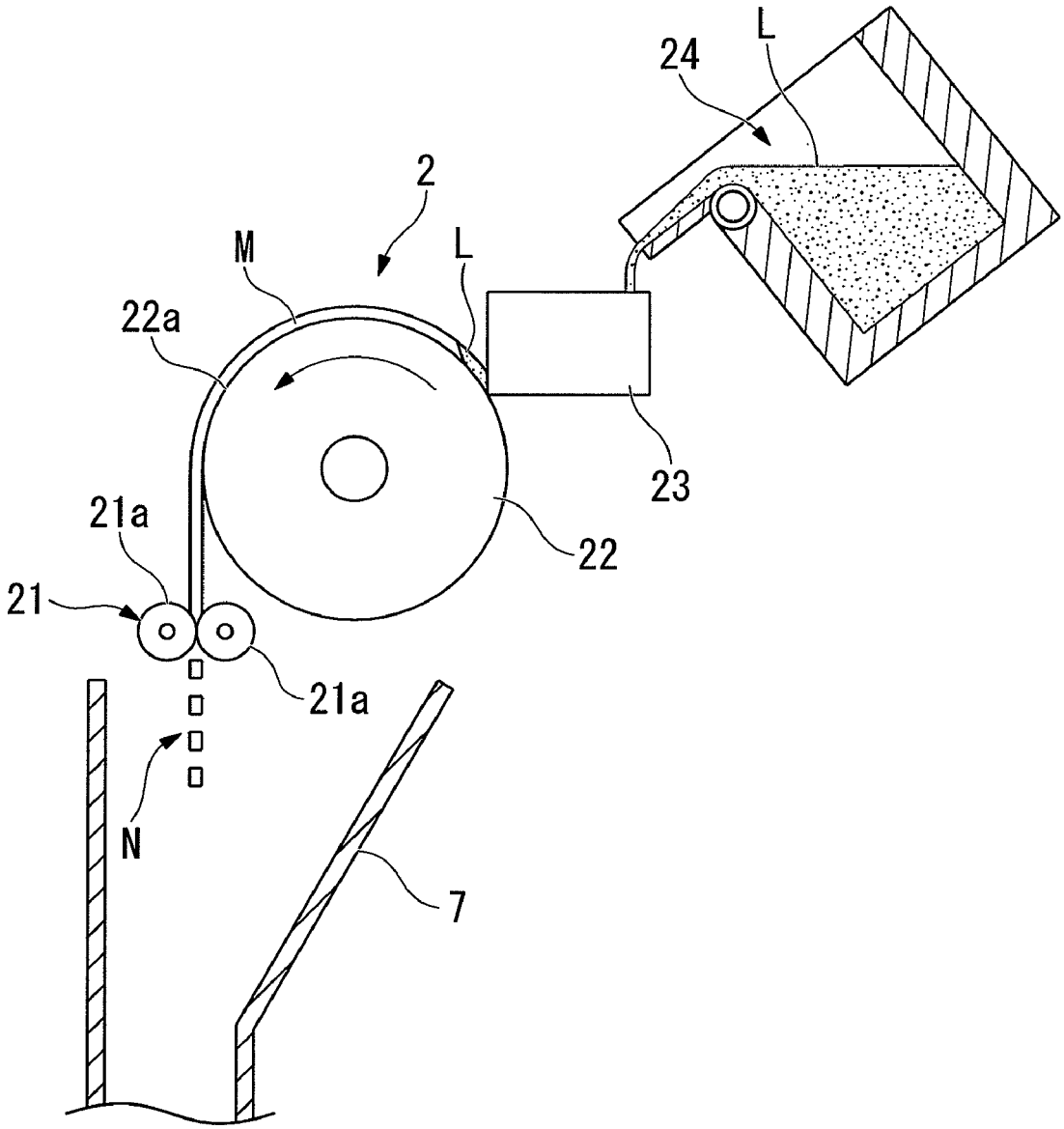
FIG. 2 is a front view showing a casting device which is provided in the apparatus for producing an alloy.

FIG. 2 is a front view showing the casting device 2 that is provided in the production apparatus 1.

As shown in FIG. 2, the casting device 2 according to the present embodiment is a device which prepares thin laminas of the cast alloy by way of crushing after casting the molten alloy using the strip cast method. In general, the casting device 2 includes a cooling roll 22 having a diameter of about 60 mm to 80 mm that casts a molten alloy L into a cast alloy M by way of rapid cooling the molten alloy; a tundish 23 that supplies the cooling roll 22 with the molten alloy L; and crushing device 21 that crushes the cast alloy M cast by the cooling roll 22 into thin laminas N of the cast alloy.

The molted alloy L is prepared in a high-frequency melting furnace which is provided outside the chamber 6 (not shown in the figures). In the high-frequency melting furnace, materials are charged into a refractory pot in a vacuum or in an atmosphere of an inert gas, and the charged materials are molten by way of the high-frequency melting method, thereby preparing a molten alloy. The temperature of the molten alloy L varies with types of alloy contents, but it is adjusted within a range of 1300° C. to 1500° C. As described in FIG. 2, the prepared molten alloy L is conveyed to the casting device 2 as it is kept in the refractory pot 24. Then, the molten alloy L is supplied to from the refractory pot 24 to the tundish 23.

The tundish 23 may be equipped with a flow-adjusting system and/or a slag-removing system where necessary. Also, the cooling roll 22 has a water-cooling system inside (not shown in the figures), and the circumferential surface 22*a* of the cooling roll 22 is cooled by the water-cooling system. With regard to the material for the cooling roll 22, a copper or copper alloy is suitable because they have excellent thermal conductivity, and are easily available. The supplying rate of the molten alloy L and the revolving speed of the cooling roll 22 are controlled according to the thickness of the cast alloy M, but it may be suitable that the revolving speed of the cooling roll 22 be about 0.5 to 3 m/s at a circumferential speed. Depending on the material for the cooling roll 22 or the condition of the circumferential surface 22*a*, metals often tend to adhere to the circumferential surface 22*a* of the cooling roll 22. Therefore, where necessary, a cleaning unit may be provided therein, so that the quality of the produced R-T-B type alloy will be stable. The cast alloy M solidified on the cooling roll 22 is separated from the cooling roll 22 at the side opposite to the tundish 23.

Figure 3:
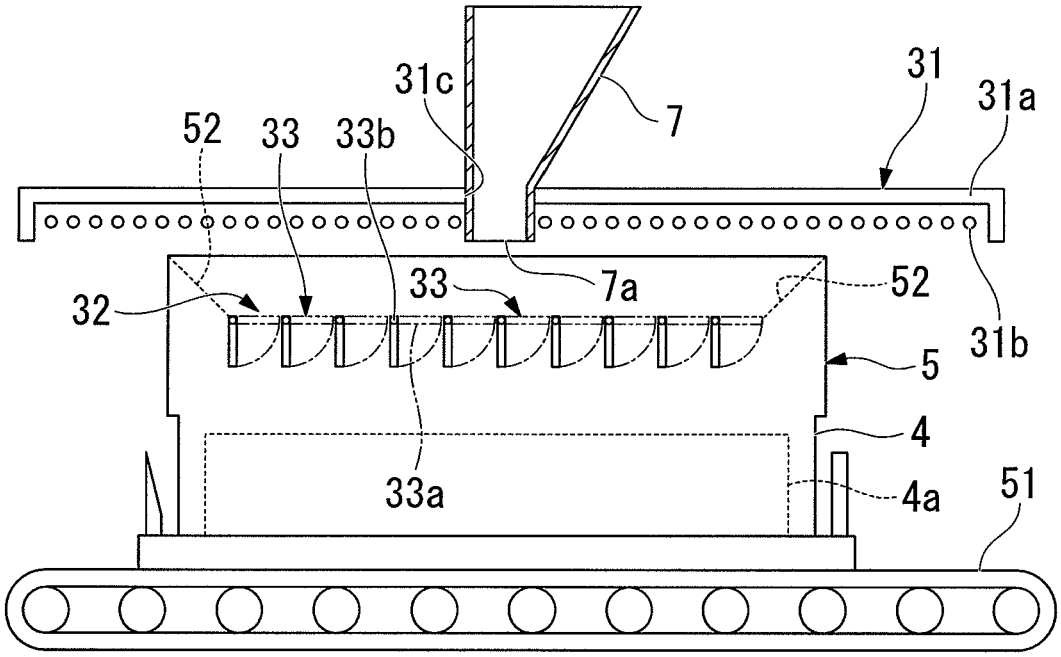
FIG. 3 is a front view showing a heating device which is provided in the apparatus for producing an alloy.

As shown in FIGS. 2 and 3, the crushing device 21, for example, includes a pair of crushing rolls 21*a*, and the cast alloy M is inserted between two rotating crushing rolls 21*a*, such that the cast alloy M is crushed into the thin laminas N of the cast alloy. The crushed thin laminas N of the cast alloy fall down through the hopper 7, and they are conveyed to the heating device 3.

[Structure of the Heating Device]

Figure 4:
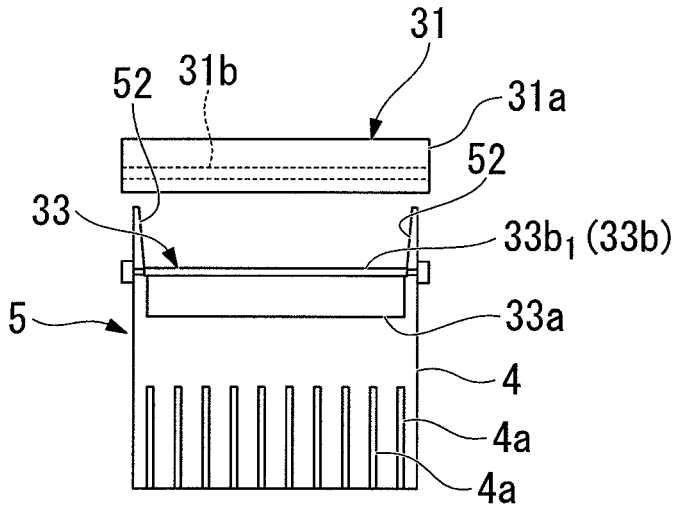
FIG. 4 is a side view showing a heating device which is provided in the apparatus for producing an alloy.
Figure 5:
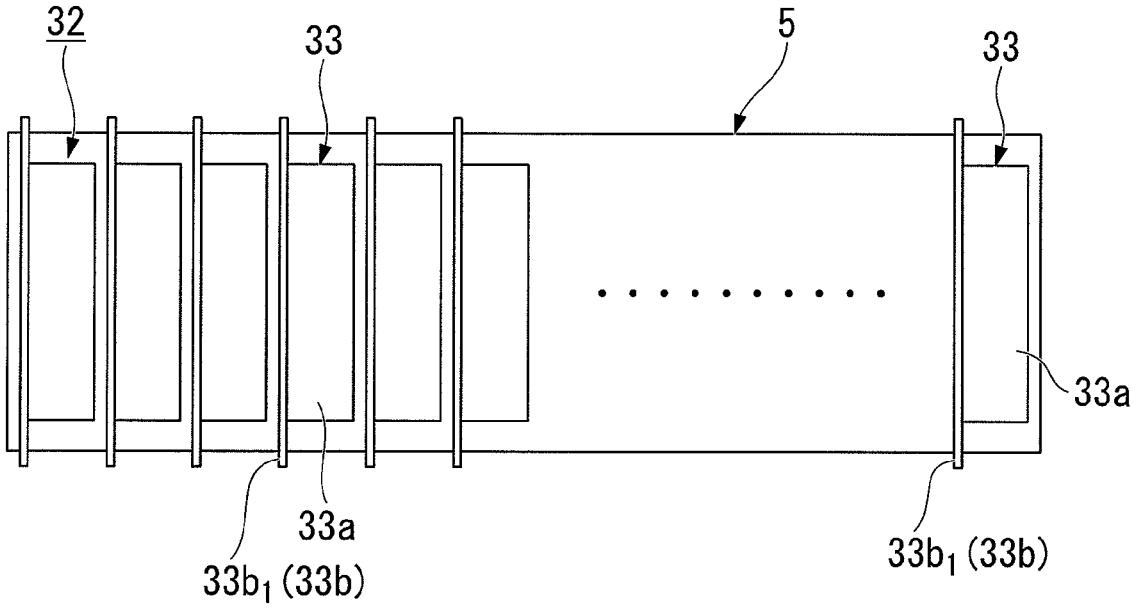
FIG. 5 is a plan view showing opening-closing stages and a container which are provided in the apparatus for producing an alloy.

FIG. 3 is a front view showing a heating device 3 which is provided in the apparatus for producing an alloy, FIG. 4 is a side view thereof, and FIG. 5 is a plan view thereof.

As shown in FIGS. 3 to 5, a heater 31 included in the heating device 3 has a heater cover 31*a*, and a main body 31*b* attached blow the heater cover 31*a*. The heater cover 31*a* is provided therein in order to release the heat generated from the main body 31*b* to the direction of the container 5, and in order to prevent the heat from being released to the casting chamber 6*a*. Also, if the heater cover 31*a* is provided therein, then it can prevent the main body 31*b* from breaking down in the event of a portion of the molten alloy or the cast alloy unexpectedly falling down thereto.

With regard to its heating system, any one of the resistance heating, infrared heating, and induction heating can be adopted. Also, the main body 31*b*, for example, may be any heating element such as metal wires, silicon carbide, and graphite.

The heater 31 has an opening part 31*c*, and an outlet 7*a* of the hopper 7 is disposed in the opening part 31*c*. Consequently, the thin laminas N of the cast alloy that falls down from the casting device 2 and that passes through the hopper 7 can be supplied to the opening-closing stage group 32 of the container 5 which is provided below the heater 31.

Moreover, the heater 31, as shown in FIGS. 1 and 3, is disposed along the longitudinal direction of the belt conveyor 51 (the moving direction of the container 5) which is provided inside the temperature-keeping storage chamber 6*b*. This configuration makes it possible to uniformly keep the temperature of the thin laminas N of the cast alloy mounted on the opening-closing stage group 32 of the container 5 or to uniformly heat them even while the container 5 moves inside the temperature-keeping storage chamber 6*b*.

The opening-closing stage group 32 included in the heating device 3 is integrated with the storage container 4 to form the container 5. That is, the container 5 shown in FIGS. 3 to 5 is formed with the storage container 4, and the opening-closing stage group 32 which is provided over the container 5.

The opening-closing stage group 32 is equipped with a plurality of opening-closing stages 33. Each opening-closing stage 33 is disposed along the moving direction of the container 5. The opening-closing stage group 32 shown in FIGS. 3 to 5 is equipped with ten opening-closing stages 33. Guide members 52 are provided around the opening-closing stage group 32, and the guide members 52 prevent the thin laminas N of the cast alloy that drop through the hopper 7 from scattering into the temperature-keeping storage chamber 6*b*.

Each opening-closing stage 33 leaves the thin laminas N of the cast alloy supplied from the casting device 2 mounted thereon to keep the temperature or to heat them with the heater 31 at a predetermined period, and drops the thin laminas N of the cast alloy to the storage container 4 after the temperature-keeping or heating period.

The opening-closing stage 33 is further explained in detail. Each opening-closing stage 33 is equipped with a stage plate 33*a*, and an opening-closing system 33*b* which opens or closes the stage plate 33*a*. Each opening-closing system 33*b* has a rotating shaft $\mathbf{33}b_1$ attached to one side of the stage plate 33*a*; and a driving unit (not shown in the figures), which rotates the rotating shaft $\mathbf{33}b_1$. Each driving unit can freely rotate the rotating shaft $\mathbf{33}b_1$, such that the inclining angle of each stage plate 33*a* can be controlled separately. The inclining angle of each stage plate 33*a* can be set anywhere in the range of 0° (where the stage plate 33*a* is horizontal (the position shown in FIG. 3 with a dashed line)) to about 90° in the clockwise-direction (where the stage plate 33*a* is almost vertical (the position shown in FIG. 3 with a continuous line)).

The opening-closing stage 33 is in a closed state when the stage plate 33*a* is in a horizontal position (when the inclining angle is about0°) or when the stage plate 33*a* is inclined to such a degree that the thin laminas N of the cast alloy do not fall down from there. On the other hand, the opening-closing stage 33 is in an opened state from the condition in which the stage plate 33*a*, for example, is slightly inclining to the condition in which the stage plate 33*a* is vertical (when the inclining angle is about 90°). When the opening-closing stage 33 is in the closed state, the thin laminas N of the cast alloy can be mounted on the stage plate 33*a*. When the opening-closing stage 33 is in an opened state, the stage plate 33*a* is in an inclined state, and the thin laminas N of the cast alloy can fall, thereby enabling them to fall into the storage container 4.

Thus, the opening-closing stage 33 can leave the thin laminas N of the cast alloy mounted on the stage plate 33*a* during a predetermined temperature-keeping period by actuating the opening-closing system 33*b*, and then, can drop the thin laminas N of the cast alloy down into the storage container 4 by making the inclining angle of the stage plate 33*a* larger.

In addition, the opening-closing stage 33 can function as a cover for the storage container 4. That is, the storage container 4 is closed when the opening-closing stages 33 are in a closed state. This prevents the heat of the heater 31 from transmitting to the storage container 4, thereby saving the inside of the storage container 4 from heating up. In this way, the opening-closing stages 33 can block the heat-transmission from the heater 31 whereby the thin laminas N of the cast alloy stored in the storage container 4 that were already subjected to the heat-keeping treatment are not subjected again to the temperature-keeping or heating, and the quality of the thin lamina N of the cast alloy is kept stable.

Next, a plurality of cooling plates 4*a* is provided inside the storage container 4 as shown in FIGS. 3 and 4. The cooling plates 4*a* are arranged in their thickness direction at a fixed interval. When the thin laminas N of the cast alloy after the temperature-keeping are in contact with the cooling plates 4*a*, the accumulated heat in the thin laminas N of the cast alloy is absorbed into the cooling plates 4*a*, and the temperature of the thin lamina N of the cast alloy declines.

Various metals such as a stainless steel, iron, HASTELLOY, and INCONEL are applied to the materials for the opening-closing stage 33 and the storage container 4 as long as they can be used at a high temperature.

As shown in FIGS. 3 and 4, the container 5 is mounted on the belt conveyor 51. The belt conveyor 51 enables the container 5 to move to the left or right side hand of FIG. 3.

[The Operation of the Apparatus for Producing an Alloy]

Next, the operation of the above-described production apparatus 1 will be explained. All FIGS. 6 to 9 are front views illustrating the operation of the apparatus for producing an alloy.

Figure 6:
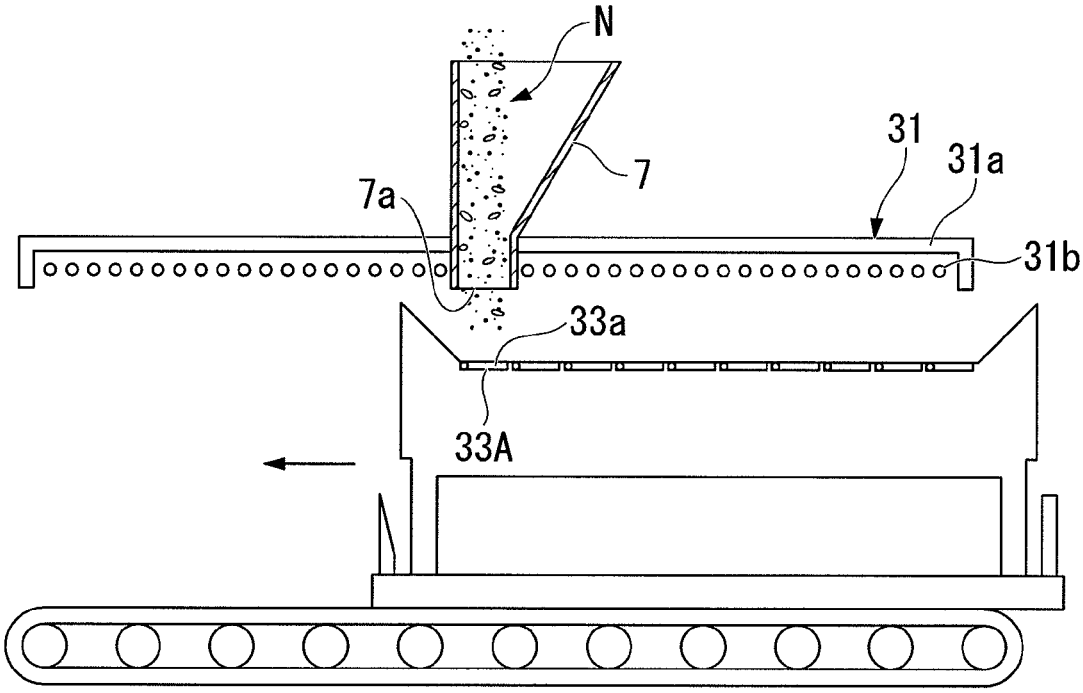
FIG. 6 is a front view illustrating the operation of the apparatus for producing an alloy.

As shown in FIG. 6, the container 5 is moved to where an opening-closing stage 33A (present at the left edge of the opening-closing stage group 32) locates directly under the outlet 7*a* of the hopper 7. Also, all opening-closing stages 33 are set in a closed state.

Then, thin laminas N of the cast alloy are prepared by actuating the casting device 2. In reference to FIG. 2, a molten alloy L is prepared in a melting device (not shown in the figures). The molten alloy L is supplied to the tundish 23, and further supplied from the tundish 23 to the cooling roll 22, whereby the molten alloy L is solidified to produce a cast alloy M. After that, the cast alloy M is displaced from the cooling roll 22, and passes through crushing rolls 21*a*, such that the cast alloy M is crushed into thin laminas N of the cast alloy.

The composition of the molten alloy L is represented, for example, by the general formula R-T-B. "R" represents mainly those in which a part of Nd is substituted with the other rare earth elements such as Pr, Dy and Tb, namely at least one of the rare earth elements including Y. "T" represents those in which a part of Fe is substituted with metals such as Co and Ni. "B" represents boron in which a part of boron can be substituted with C or N. In addition, Cu, Al, Ti, V, Cr, Ga, Mn, Nb, Ta, Mo, W, Ca, Sn, Zr, Hf, etc. may be added singularly or in combination as additional elements. The composition ratios of R and B are 28 to 33% and 0.9 to 1.3% by mass respectively, and the balance is T. A part of R may be substituted with 15% by mass of Dy and/or 15% by mass of Tb. However, the composition of the molten alloy applied to the production apparatus 1 of the present invention is not limited to the above-described range, and any composition for R-T-B type alloys can be applied.

It is preferable that the average cooling speed of the molten alloy on the cooling roll 22 be 300° C. to 3000° C. per second. When the cooling speed is 300° C. per second or more, sufficient cooling speed can prevent the deposition of α-Fe, and can prevent organizations such as an R-rich phase and $R_2T_{17}$-phase from being coarse. When the cooling speed is 3000° C. per second or less, its cooling rate does not grow excessive whereby the thin laminas of the cast alloy can be supplied to the heating device 3 at a proper temperature. Also, there is a merit that the thin laminas of the cast alloy are not excessively cooled, and therefore, it is unnecessary for them to be heated again. In addition, the average cooling speed can be calculated by dividing the difference between the temperatures of the molten alloy directly before touching the cooling roll and when separating from the cooling roll by the time that the molten alloy touches the cooling roll.

Furthermore, the average temperature of the cast alloy M when separating from the cooling roll will slightly vary depending on a slight change in the condition of touching the cooling roll 22, changes of the thickness, among others. For example, the surface of the alloy is scanned in the cross direction with a radiation thermometer from when casting begins to when casting ends whereby the average temperature of the cast alloy M when separating from the cooling roll can be calculated by averaging the measured values.

It is preferable that the average temperature of the cast alloy M when separating from the cooling roll 22 be lower by 100 to 500° C. than the solidifying temperature of the molten alloy in the equilibrium state of the $R_2T_{14}B$-phase, and it is more preferably lower by 100 to 400° C. The melting temperature of the $R_2T_{14}B$-phase is around 1150° C. in the ternary system of Nd—Fe—B. However, the melting temperature varies according to the substitution of Nd to the other rare earth elements, the substitution of Fe to the other transition elements, and types or amounts of the other additional elements. If the difference between the average temperature of the cast alloy M when separating from the cooling roll 22, and the solidifying temperature of the cast alloy M in the equilibrium state of the $R_2T_{14}B$-phase is less than 100° C., the cooling speed is insufficient. On the other hand, if the difference is over 500° C., the cooling speed is too fast, and the cooling of the molten alloy becomes excessive. The degree of such excessive cooling is not uniform inside the alloy, and it varies depending on the condition of touching the cooling roll, and the distance from the site contacting with the cooling roll.

Next, as shown in FIG. 6, the crushed thin laminas N of the cast alloy pass through the hopper 7, and pile (mount) on the opening-closing stage 33A which is positioned directly under the outlet 7*a* of the hopper 7. During this time, the heater 31 is switched on, the thin laminas N of the cast alloy are kept at a predetermined temperature or heated by the heater 31 directly after they are piled on the opening-closing stage 33A.

The amount of the thin laminas N of the cast alloy piled on the opening-closing stage 33A may be properly adjusted according to the area of the stage plate 33*a*. However, the thin laminas N of the cast alloy are continuously supplied from the casting device 2, they will overflow from the opening-closing stage 33A in time although it also depends on the supplying speed.

Figure 7:
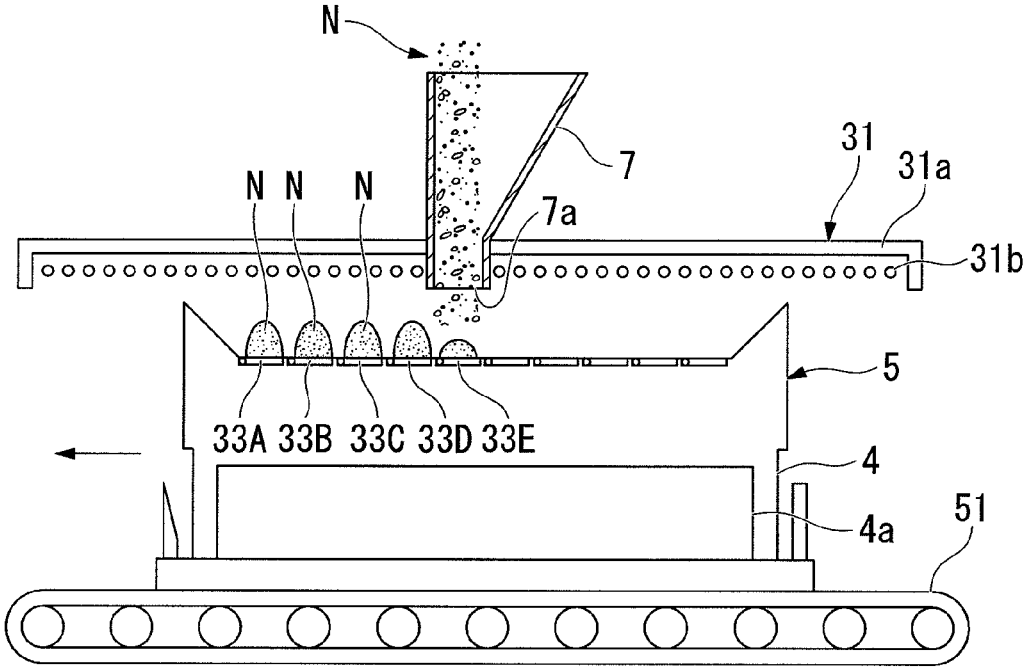
FIG. 7 is a front view illustrating the operation of the apparatus for producing an alloy.

Therefore, in the production apparatus 1 of the present embodiment, the container 5 is moved to the left side hand as shown in FIG. 7 when the piling amount of the thin laminas N of the cast alloy reaches a predetermined value with respect to the opening-closing stage 33A. Then, another opening-closing stage 33B next to the opening-closing stage 33A on the right side is positioned directly under the outlet 7*a* of the hopper 7, followed by the thin laminas N of the cast alloy being piled on the opening-closing stage 33B. After that, in the same way, the container 5 is moved in accordance with the preparation of the thin laminas N of the cast alloy, and the thin laminas N of the cast alloy are piled sequentially on the opening-closing stages 33C to 33E. Specifically, in the present invention, the preparation of the thin laminas N of the cast alloy refers to the supplying rate of the thin laminas N of the cast alloy thereto, or production rate thereof.

The piling amount of the thin laminas N of the cast alloy with respect to each of the opening-closing stages 33A to 33E may be monitored with their mass by providing each stage plate 33*a* with a mass-detecting system, or may be controlled by adjusting the piling period with respect to each stage plate 33*a* based on the production amount of the thin laminas N of the cast alloy per time that is calculated from the casting or crushing speed of the casting device 2.

During this time, the thin laminas N of the cast alloy piled on each of the opening-closing stages 33A to 33E are kept at a predetermined temperature or heated with the heater 31. It is preferable that the keeping temperature be lower than the temperature of the thin lamina N when separating from the cooling roll (separating temperature), and for example, it is preferably within a range of (the separating temperature—100° C.) to the separating temperature, and it is more preferably within a range of (the separating temperature—50° C.) to the separating temperature. More specifically, the keeping temperature is preferably within a range of 600° C. to 900° C. Also, when the separating temperature declines for any reason, the thin laminas N of the cast alloy can be heated and kept at a predetermined temperature by setting the keeping temperature higher than the separating temperature. It is preferable that the heating range be within 100° C., and more preferably within 50° C. If the heating range is too large, the yield will decline.

Furthermore, the period of the temperature-keeping is preferably 30 seconds or more, more preferably 30 seconds to about several hours, and most preferably 30 seconds to 30 minutes. The coercive force of the R-T-B type alloy can be enhanced by way of subjecting the thin laminas N of the cast alloy to the temperature-keeping treatment. When the keeping temperature is 600° C. or more, the coercive force can be sufficiently enhanced. Also, when the coercive force is 900° C. or less, the deposition of α-Fe can be prevented, and the organizations such as the R-rich phase and the $R_2T_{17}$-phase can be prevented from being coarse. If the temperature-keeping time is 30 seconds or more, then the coercive force can be sufficiently enhanced. That is, the thin laminas of the cast alloy may be subjected to the temperature-keeping treatment for several hours, but the temperature-keeping time is preferably 30 minutes or less in terms of the yielding efficiency.

In addition, if they are kept at 1000° C., the coercive force can be improved. However, such a temperature makes organizations coarse. Furthermore, the particle distribution or the fluidity of the fine powder when they are finely crushed, and the sintering temperature may unfavorably change. When they are kept at 1000° C., it is required to consider its influence to subsequent processes.

Figure 8:
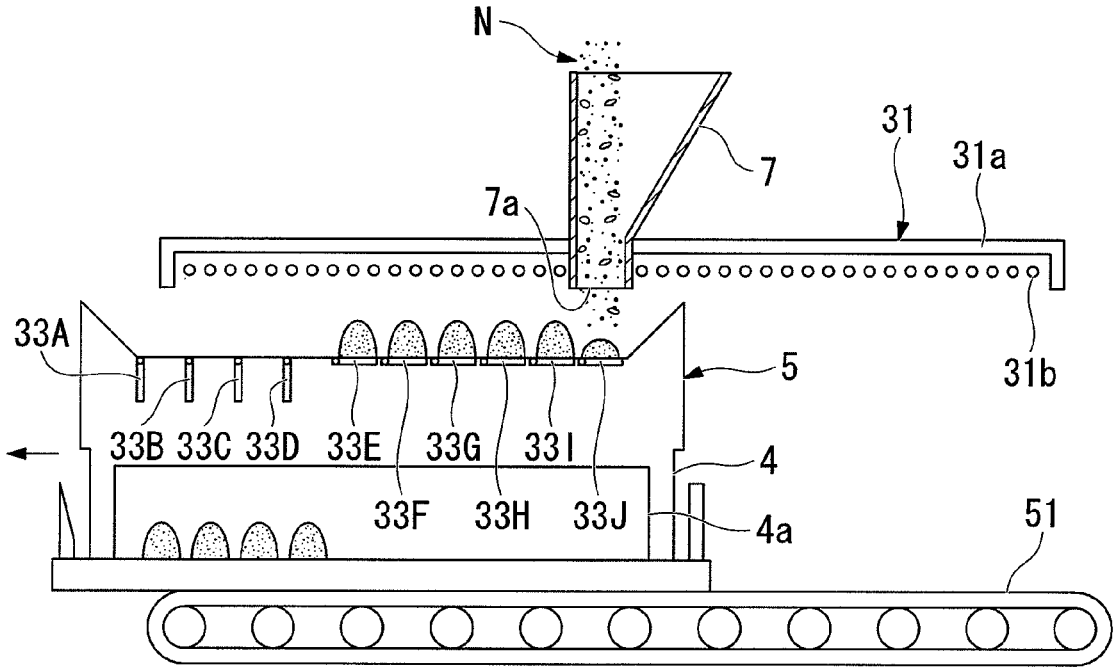
FIG. 8 is a front view illustrating the operation of the apparatus for producing an alloy.

Next, as shown in FIG. 8, the container 5 is further moved with respect to the rest of the opening-closing stages 33F to 33J in accordance with the preparation of the thin laminas N of the cast alloy in the same way whereby the thin laminas N of the cast alloy are successively piled on each of the opening-closing stages 33F to 33H.

Figure 9:
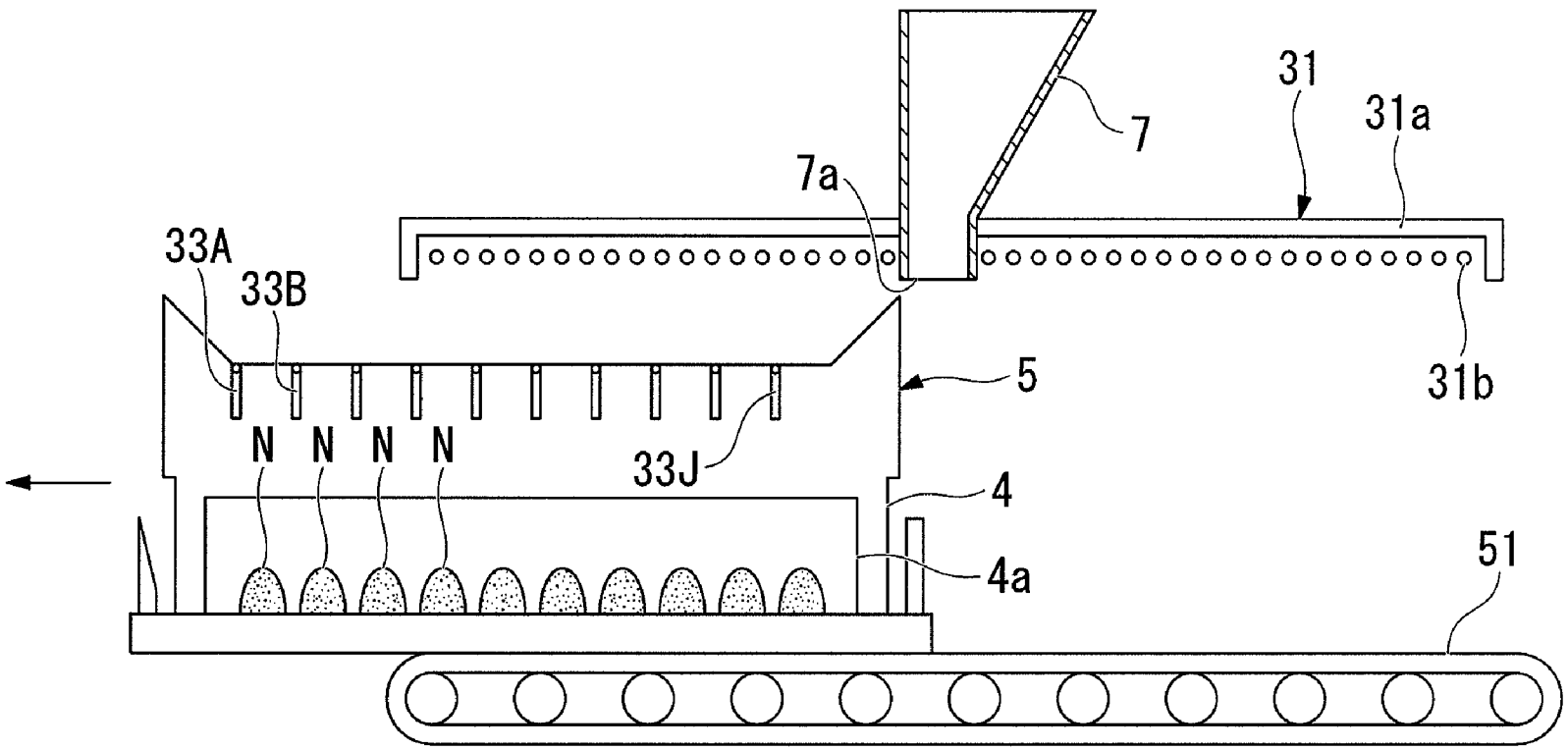
FIG. 9 is a front view illustrating the operation of the apparatus for producing an alloy.

With regard to the thin laminas N of the cast alloy piled on the opening-closing stages 33A to 33E, they are successively dropped into the storage container 4 by making each opening-closing stage in an opened state as shown in FIG. 9 when the predetermined temperature-keeping time or heating time passes. Once the thin laminas N of the cast alloy are dropped into the storage container 4, the heat of the heater 31 no longer transmits to the thin laminas N of the cast alloy so that the temperature-keeping treatment is finished.

As described above by referring to FIG. 7, thin laminas N of the cast alloy are successively mounted on each opening-closing stage, and the different opening-closing stages consequently have time-differences in the starting point to start the temperature-keeping treatment with respect to the thin laminas N of the cast alloy on the opening-closing stages. Therefore, it is preferable that the thin laminas N of the cast alloy are successively dropped into the storage container 4 by successively switching each opening-closing stage to in an opened state in order to fix the temperature-keeping time with respect to thin laminas N of the cast alloy on each opening-closing stage.

The thin laminas N of the cast alloy that dropped into the storage container 4 are in contact with the cooling plate 4*a* whereby the heat is absorbed into the cooling plate 4*a*, and the thin laminas N of the cast alloy are consequently cooled down.

Figure 10:
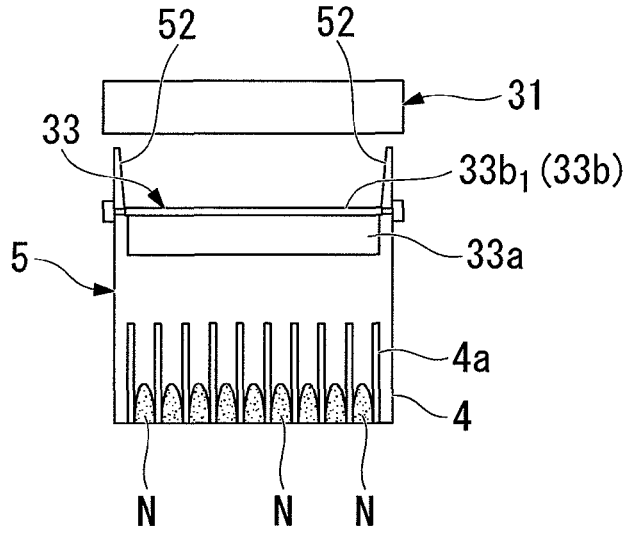
FIG. 10 is side view illustrating the operation of the apparatus for producing an alloy.

FIGS. 9 and 10 show a state in which all opening-closing stages 33 are in an opened state, and the thin laminas N of the cast alloy are stored in the storage container 4.

If the casting and crushing processes by the casting device 2 are subsequently conducted after that, the container 5 can be moved to the right hand in the figures while all opening-closing stages 33 are made in a closed state, and the thin laminas N of the cast alloy are successively mounted on each opening-closing stage 33 in accordance with the preparation of the thin laminas N of the cast alloy.

To the contrary, if the casting and crushing processes by the casting device 2 are terminated, all opening-closing stages 33 are switched to in a closed state to prevent the heat of the heater 31 from reaching the storage container 4. Then, the gate 6*e* of the temperature-keeping storage chamber 6*b* is opened, and the container 5 is conveyed outside the chamber 6.

Also, if a cooling chamber is provided in the chamber, the gate 6*e* of the temperature-keeping storage chamber 6*b* is opened, the container 5 is conveyed to the cooling chamber, and the thin laminas N of the cast alloy inside the container 5 are allowed to stand in order to cool. When the cooling is completed, the gate of the cooling chamber is opened, and the container 5 may be carried outside the chamber 6.

As explained above, because the production apparatus 1 is equipped with the heating device 3 that keeps the thin laminas N of the cast alloy at a predetermined temperature or that heats them, the coercive force of the thin laminas N of the cast alloy made of the R-T-B type alloy can be improved whereby an R-T-B type magnet having excellent heat-resistance can be produced.

Also, the production apparatus 1 is equipped with the opening-closing stages 33 on which the thin laminas N of the cast alloy supplied from the casting device are mounted when they are in a closed state, and that drops the thin laminas N of the cast alloy into the storage container 4 when they are in an opened state; and the heater 31 that keeps the thin laminas N of the cast alloy mounted on the opening-closing stages 33 at a predetermined temperature or that heats them. This is why the temperature-keeping time for the thin laminas N of the cast alloy can be controlled by adjusting the opening or closing period of the opening-closing stages 33 without switching the heater 31 on or off, and this also results in miniaturization of the apparatus.

Also, according to the above production apparatus 1, the opening-closing stages 33 release the thin laminas N of the cast alloy to the storage container 4 when a predetermined temperature-keeping time passes after the thin laminas N of the alloy are mounted thereon whereby the coercive force of thin laminas N of the cast alloy can be greatly improved.

Also, according to the production apparatus 1, the heating device 3 is disposed below the casting device 2 whereby the thin laminas N of the cast alloy can be easily moved between two or three of the devices only by way of dropping them. Therefore, it is unnecessary to provide another system for delivering the thin laminas N of the cast alloy, and this can result in the miniaturization or space-saving for the production apparatus 1.

Also, according to the production apparatus 1, the storage container 4 and the opening-closing stages 33 are integrated to form the container 5 whereby the total thin laminas N of the cast alloy after the temperature-keeping treatment can be released to the storage container 4 without loss thereof. Also, because the storage container 4 and the opening-closing stages 33 are integrated to form one body, the miniaturization or space-saving for the production apparatus 1 can be achieved. Furthermore, the belt conveyor 51 which freely moves the container 5 is provided therein whereby the thin laminas N of the cast alloy after the temperature-keeping treatment can be quickly delivered out from the production apparatus 1.

Also, according to the production apparatus 1, the container 5 is equipped with a plurality of the opening-closing stages 33, and each opening-closing stage 33 is disposed along the moving-direction of the container 5 whereby thin laminas N of the cast alloy can be successively mounted on each opening-closing stage 33 by moving the container 5 even if thin laminas N of the cast alloy are continuously supplied from the casting device 2. Consequently, the thin laminas N of the cast alloy will not overflow from each opening-closing stage 33.

Also, according to the production apparatus 1, the thin laminas N of the cast alloy are successively released to the storage container 4 when a predetermined temperature-keeping time passes after the thin laminas N of the cast alloy are mounted on each opening-closing stage 33 whereby the temperature-keeping time can be fixed and the quality of the thin laminas N of the cast alloy can be consequently kept uniform.

Also, according to the production apparatus 1, the heater 31 is disposed between the casting device 2 and the opening-closing stages 33 along the moving direction of the container 5 whereby the distance between the thin laminas N of the cast alloy on each opening-closing stage 33 and the heater 31 can be fixed even while the container 5 moves. Consequently, the thin laminas N of the cast alloy can always be kept at a predetermined temperature in the same conditions.

Also, according to the production apparatus 1, the storage container 4 is equipped with the cooling plate 4*a* that cools the thin laminas N of the cast alloy whereby the thin laminas N of the cast alloy after the temperature-keeping treatment can be quickly cooled. Consequently, the temperature-keeping time will not be substantially extended, and the quality of the thin laminas N of the cast alloy can be improved.

Also, according to the production apparatus 1, the casting device 2 is equipped with the crushing device 21 whereby blocks of the cast alloy can be easily crushed into thin laminas N of the cast alloy, and this consequently makes it easier to treat the cast alloy in the heating device 3 or the storage container 4.

Also, according to the production apparatus 1, the hopper 7 that directs the thin laminas N of the cast alloy onto the opening-closing stages 33 is provided between the crushing device 21 and the opening-closing stages 33 whereby the thin laminas N of the cast alloy will not scatter inside the temperature-keeping storage chamber 6*b*, and the entire amount of the thin laminas N of the alloy can be delivered to the opening-closing stages 33 without loss thereof.

Also, according to the production apparatus 1, the heater 31 has the opening part 31*c*, and the outlet 7*a* of the hopper 7 is disposed in the opening part 31*c* whereby the outlet 7*a* of the hopper 7 faces the opening-closing stage 33 of the container 5, and the entire amount of the thin laminas N of the alloy can be therefore delivered to the opening-closing stages 33 without loss thereof as well as miniaturization and space-saving for the production apparatus 1 can be achieved.

Also, according to the production apparatus 1, the casting device 2 and the heating device 3 are provided inside the chamber 6 of an atmosphere of an inert gas whereby the R-T-B type alloy can be prevented from deteriorating.

Also, according to the production apparatus 1, a cooling chamber is provided inside the chamber 6, and the container 5 can be moved to the cooling chamber whereby the thin laminas N of the cast alloy stored in the container 5 that have already subjected to the temperature-keeping treatment can be delivered from the temperature-keeping storage chamber 6*b*, and they can be cooled. Consequently, the yield can be improved.

Also, according to the production apparatus 1, the rare earth element-containing alloy is an R-T-B type alloy whereby a magnet having high coercive force and excellent heat resistance can be produced.

The R-T-B type alloy is an alloy that mainly includes an element "R" where a part of Nd is substituted with the other rare earth elements such as Pr, Dy and Tb; an element "T" where a part of Fe is substituted with metals such as Co and Ni; and "B" (boron). The coercive force of the R-T-B type magnet formed of such an alloy generally increases as the composition ratios of Dy and Tb in the R-T-B type alloy increase, but the remanent magnetic flux density tends to decline on the contrary.

According to the production apparatus 1, the R-T-B type alloy can be subjected to the temperature-keeping treatment because the heating device 3 is provided therein whereby the coercive force of the magnet formed of the R-T-B type alloy can be improved. Consequently, the composition ratios of Dy and Tb in the alloy can be reduced. In addition, when the composition ratios of Dy and Tb in the alloy are reduced, the remanent magnetic flux density can also be improved.

The heating device is not limited to the above-described embodiment, and embodiments shown in FIGS. 11 to 14 may be applied.

Figure 11:
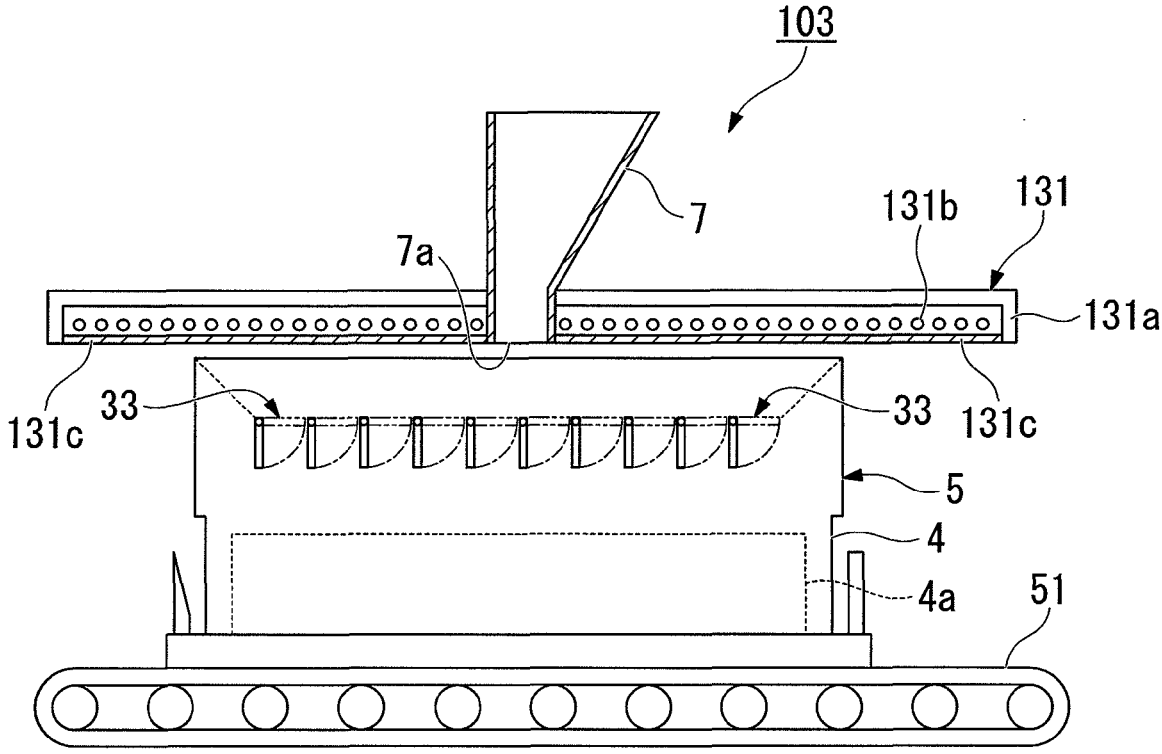
FIG. 11 is a front view showing another example of the heating device which is provided in the apparatus for producing an alloy.

FIG. 11 shows another embodiment for the heating device. The difference between a heating device 103 shown in FIG. 11 and the heating device 3 shown in FIG. 1 and FIGS. 3 to 5 is that a heater 131 is equipped with a protective cover 131*c*.

That is, the heater 131 shown in FIG. 11 includes a heater cover 131*a*; a main body 131*b* provided below the heater cover 131*a*; and the protective cover 131*c* that is attached to the heater cover 131*a* to protect the main body 131*b*. The heater cover 131*a* is provided in order to release the heat generated from the main body 131*b* in the direction of the container 5 and in order to prevent the heat from the main body 131*b* from emitting to the casting chamber 6*a*. Also, the heater cover 131*a* can protect the main body 131*b* from breaking down even if a portion of the molten alloy or the cast alloy drops from the casting device 2 thereto.

Also, the protective cover 131*c* is disposed between the main body 131*b* and the container 5. When the thin laminas N of the cast alloy fall down to the opening-closing stages 33 of the container, the thin laminas N of the cast alloy may strike against the main body 131*b* because they rebound on the opening-closing stages 33. However, the protective cover 131*c* can protect the main body 131*b* from the thin laminas N of the cast alloy. In addition, the heater emitted from the main body 131*b* is radiated onto the thin laminas N of the cast alloy on the opening-closing stages 33 through the protective cover 131*c*.

The protective cover 131*c* may be a plate-shaped or mesh-like structure. If the protective cover 131*c* is plate-shaped, the use of a material that has excellent thermal conductivity and heat-radiation efficiency is preferable in order to sufficiently radiate the heat to the thin laminas N of the cast alloy. If it is mesh-like, it is preferable to use those which have pore sizes where the thin laminas N of the cast alloy cannot pass through the protective cover.

Figure 12:
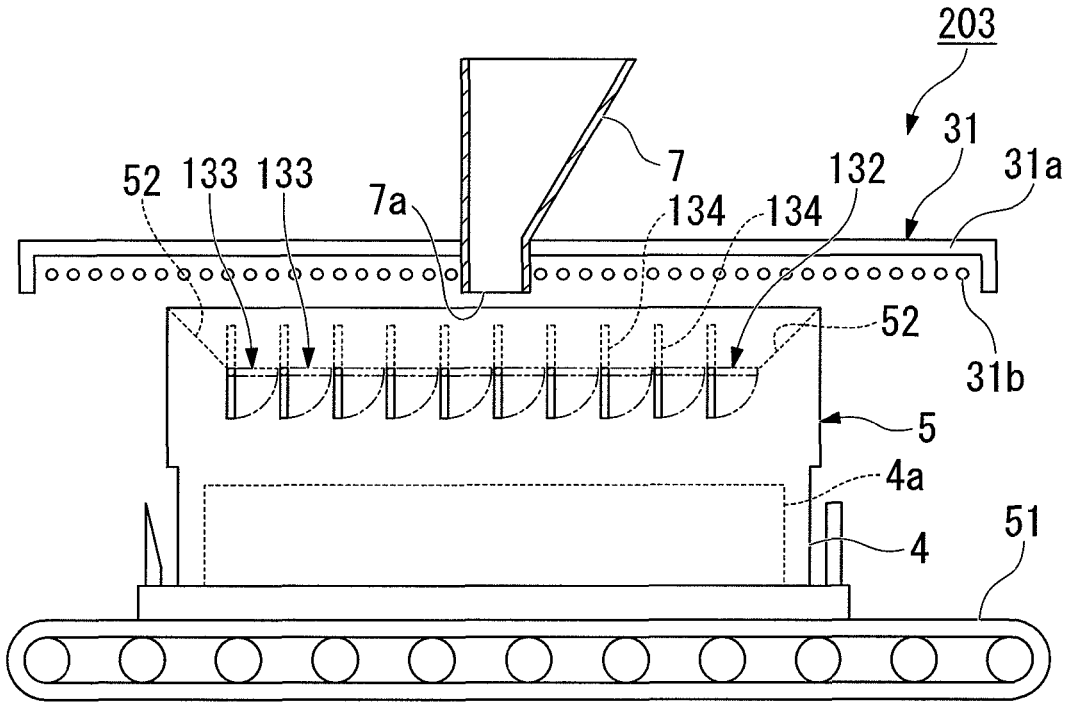
FIG. 12 is a front view showing another example of the heating device which is provided in the apparatus for producing an alloy.

Next, FIG. 12 shows yet another embodiment for the heating device. The difference between a heating device 203 shown in FIG. 12 and the heating device 3 shown in FIG. 1 and FIGS. 3 to 5 is that partition panels 134 are provided between the opening-closing stages 133 of the opening-closing stage group 132.

That is, the opening-closing stage group 132 illustrated in FIG. 12 has a plurality of the opening-closing stages 133, and the each opening-closing stage 133 is arranged along the moving-direction of the container 5. The opening-closing stage group 132 shown in FIG. 12 has ten opening-closing stages 133. Also, guide members 52 are provided around the opening-closing stage group 132, and the guide members 52 prevent the thin laminas N of the cast alloy that has dropped through the hopper 7 from scattering into the temperature-keeping storage chamber 6*b*.

Moreover, the partition panels 134 are provided on the boundary of each opening-closing stage 133. Each partition panel 134 is set to stand facing the direction of the heater 31.

When the thin laminas N of the cast alloy fall down to the opening-closing stages 133, the thin laminas N of the cast alloy rebound on the opening-closing stage 133, and may scatter into adjacent opening-closing stages 133. However, the partition panel 134 can prevent the thin laminas N of the cast alloy from scattering.

Furthermore, the partition panel 134 can prevent the thin laminas N of the cast alloy from piling around a boundary part of the opening-closing stage 133, and the all thin laminas N can be dropped into the storage container 4 without leaving them thereon.

In addition, the partition panel 134 may include an auxiliary heater in order to assist temperature-keeping for the thin laminas N of the cast alloy on the opening-closing stage 133. The use of the auxiliary heater can uniformly keep the temperature of the thin laminas N of the cast alloy.

Figure 13:
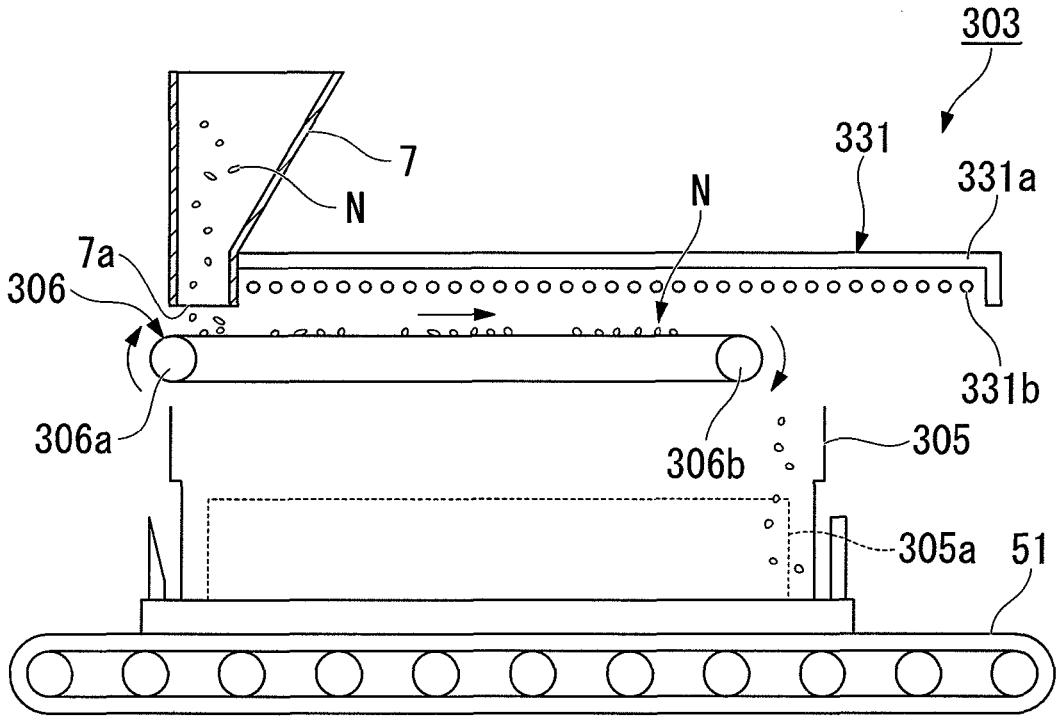
FIG. 13 is a front view showing another example of the heating device which is provided in the apparatus for producing an alloy.

Next, FIG. 13 illustrates yet another embodiment for the heating device. The difference between a heating device 303 shown in FIG. 13 and the heating device 3 shown in FIG. 1 and FIGS. 3 to 5 is that a belt conveyor 306 is provided between a heater 331 and a container 305 instead of the opening-closing stage group 132.

That is, the heating device 303 shown in FIG. 13 includes the heater 331; the container 305; and the belt conveyor 306 provided between the heater 331 and the container 305. The belt conveyor 306 carries the thin laminas N of the cast alloy to the container 305 while keeping them at a predetermined temperature supplied from the casting device. Also, the container 305 is equipped with a cooling plate 305*a*.

The heater 331 includes a heater cover 331*a* and a main body 331*b* provided under the heater cover 331*a*. The function, the material, etc. of the heater cover 331*a* and the main body 331*b* are arranged in the same manner as the above-described heater 31.

Moreover, an outlet 7*a* of the hopper 7 is provided at the left side of the heater 331 whereby the thin laminas N of the cast alloy which have dropped from the casting device 2 through the hopper 7 can be delivered out to the belt conveyor 306.

Furthermore, the heater 331 is disposed along the longitudinal direction of the belt conveyor 306 at a regular distance from each other as shown in FIG. 13. This configuration can achieve the uniform temperature-keeping of thin laminas N of the cast alloy that are conveyed by the belt conveyor 306.

In addition, in the heating device 303 shown in FIG. 13, another heater may be provided between the belt conveyor 306 and the container 305 in order to heat the belt of the belt conveyor 306.

Next, the belt conveyor 306 is disposed such that the end part 306*a* is arranged directly under the outlet 7*a* of the hopper 7 and the end part 306*b* is arranged directly over the container 305. The belt conveyor 306 extends from the end part 306*a* to the end part 306*b* along the heater 331. Also, the distance between the belt conveyor 306 and the heater 331 is almost fixed.

According to the above-described configuration, the thin laminas N of the cast alloy that has dropped from the casting device 2 through the hopper 7 can be subjected to the temperature-keeping by the heater 331 while being delivered by the belt conveyor 306. Then, the thin laminas N of the cast alloy can be released from the end part 306*b* of the belt conveyor 306 to the container 305. With regard to the temperature-keeping time, the starting point refers to when the thin laminas N of the cast alloy reach the belt conveyor 306, and the ending point refers to when they are sent from the end part 306*b* of the belt conveyor 306 to the container 305. Consequently, the temperature-keeping time can be adjusted by way of adjusting the driving speed of the belt conveyor 306.

Thus, according to the heating device 303 shown in FIG. 13, the thin laminas N of the cast alloy that are continuously supplied can be kept at a predetermined temperature or heated, and the period for the temperature-keeping or heating can be fixed.

In addition, the container 305 is provided on another belt conveyor 51, and the container 305 can be moved to either the left or the right side hand of the figure. According to this structure, the relative position of the container 305 to the end part 306*b* of the belt conveyor 306 can be freely adjustable whereby the thin laminas N of the cast alloy can be prevented from piling at the same position of the container 305.

Figure 14:
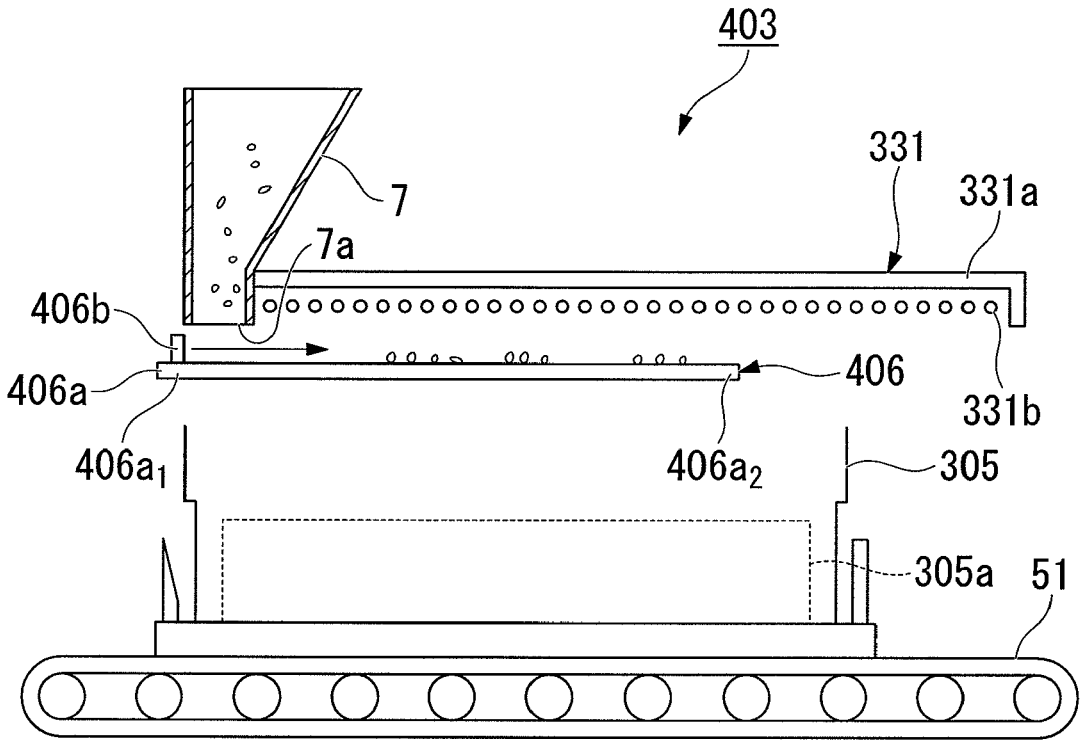
FIG. 14 is a front view showing another example of the heating device which is provided in the apparatus for producing an alloy.

Next, FIG. 14 shows yet another embodiment for the heating device. The difference between a heating device 403 shown in FIG. 14 and the heating device 303 shown in FIG. 13 is that a pushing device 406 is disposed between a heater 331 and a container 305 instead of the belt conveyor 306.

That is, the heating device 403 includes a heater 331; a container 305; the pushing device 406 disposed between the heater 331 and the container 305. The pushing device 406 delivers the thin laminas N of the cast alloy, which are supplied from the casting device, to the container 305 while they are kept at a predetermined temperature. In addition, the container 305 is equipped with a cooling plate 305*a*.

A heater 331 includes a heater cover 331*a*; a main body 331*b* provided under the heater cover 331*a*. The function, material, etc. of the heater cover 331*a* and the main body 331*b* are arranged in the same manner as the above-described heater 31.

Also, an outlet 7*a* of a hopper 7 is disposed at the left side of the heater 331 whereby the thin laminas N of the cast alloy that have been dropped the casting device 2 passing through the hopper 7 can be released to the pushing device 406.

Moreover, the heater 331, as shown in FIG. 14, is disposed along the longitudinal direction of the pushing device 406. This configuration can achieve uniform temperature-keeping of the thin laminas N of the cast alloy that are conveyed by the pushing device 406.

In addition, in a heating device 403 shown in FIG. 14, another heater may be provided between a base plate 406*a* and the container 305 in order to heat the base plate 406*a*.

Next, the pushing device 406 includes the base plate 406*a*; and a pushing member 406*b* that slides on the base plate 406*a*. The base plate 406*a* is disposed such that the end part 406$a_1$ is arranged directly under the outlet 7*a* of the hopper 7 and another end part 406$a_2$ is arranged directly over the container 305. The base plate 406*a* extends from the end part 406$a_1$ to the end part 406$a_2$ along the heater 331. Also, the distance between the base plate 406*a* and the heater 331 is almost fixed. The pushing member 406*b* moves from the end part 406$a_1$ of the base plate 406*a* toward the end part 406$a_2$ while being in contact with the base plate 406*a*. To the contrary, the pushing member 406*b* moves back from the end part 406$a_2$ to the end part 406$a_1$ while separating from the base plate 406*a*.

According to the above-described configuration, the thin laminas N of the cast alloy that have been dropped from the casting device 2 passing from the hopper 7 are piled on the base plate 406*a*, and the thin laminas N of the cast alloy are kept at a predetermined temperature by the heater 331 while the pushing member 406*b* delivers them to the end part 406$a_2$ of the base plate by way of pushing. Then, the thin laminas N of the cast alloy are released from the end part 406$a_2$ of the base plate 406*a* to the container 305. With regard to the temperature-keeping time, the starting point refers to when the thin laminas N of the cast alloy reach the base plate 406*a*, and the ending point refers to when they are sent from the end part 406$a_2$ of the base plate 406*a* to the container 305. Consequently, the period for the temperature-keeping can be adjusted by way of controlling the driving speed of the pushing member 406*b*.

Thus, according to the heating device 403 shown in FIG. 14, the thin laminas N of the cast alloy that are continuously supplied can be kept at a predetermined temperature or heated, and the period for the temperature-keeping or heating can be fixed.

In the same manner as FIG. 13, the container 305 is provided on a belt conveyor 51, and the container 305 can move to either left or right side hand of the figure. According to this structure, the relative position of the container 305 to the end part 406$a_2$ of the base plate 406*a* of the pushing device 406 is freely adjustable whereby the thin laminas N of the cast alloy can be prevented from piling at the same position of the container 305.

Figure 15:
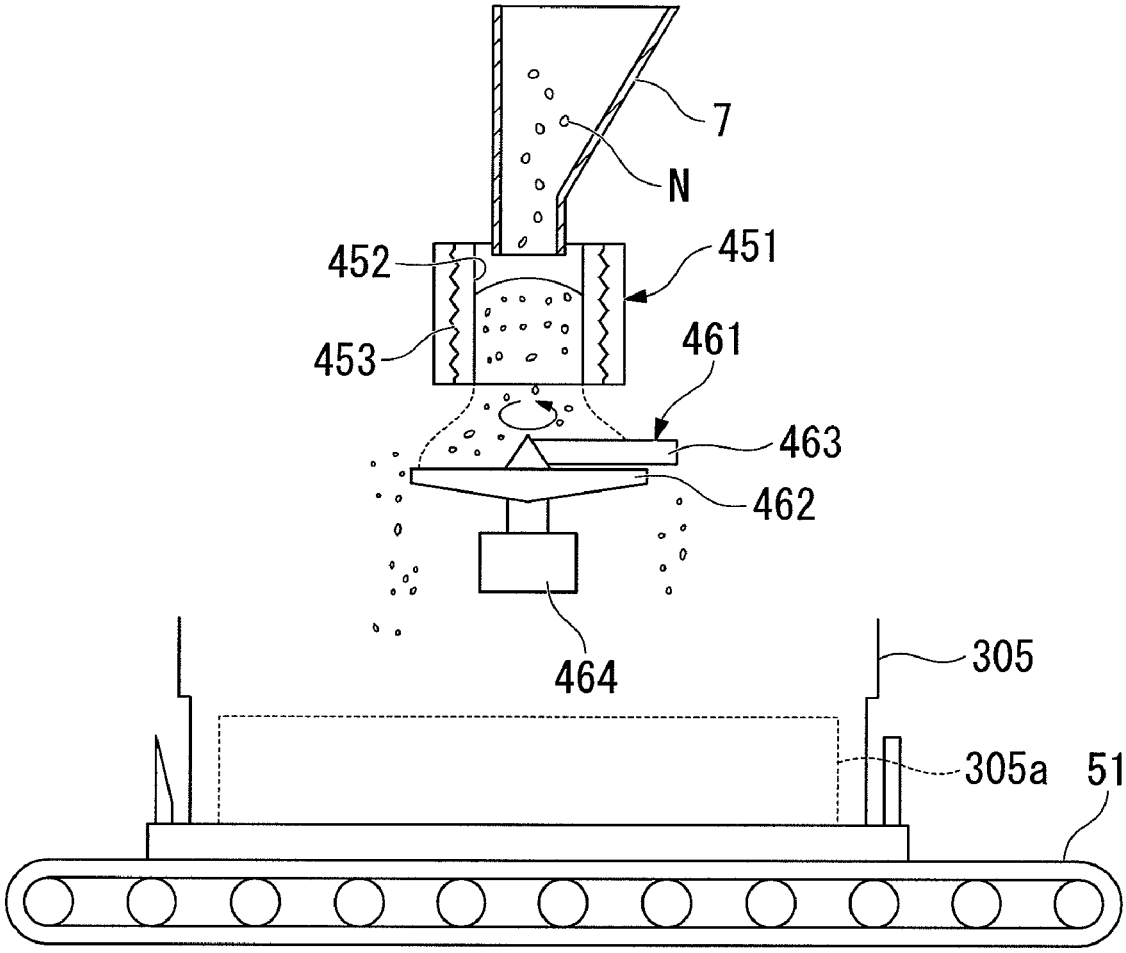
FIG. 15 is a front view showing another example of the heating device which is provided in the apparatus for producing an alloy.

Next, FIG. 15 further shows still another embodiment for the heating device. The difference between a heating device shown in FIG. 15 and the heating device 303 shown in FIG. 13 is that a vertical furnace 451 and a table feeder are provided therein instead of the heater 331 and the belt conveyor 306.

The vertical furnace 451 shown in FIG. 15 includes a thin lamina-path 452; an outside heater 453 provided in the circumference of the thin lamina-path 452. Also, a hopper 7 through which the thin laminas N of the cast alloy supplied from the casting device 2 is disposed on the entrance-side of the thin lamina-path 452. The table feeder 461 is disposed on the exit-side of the thin lamina-path 452. The container 305 is disposed under the table feeder 461. The table feeder 461 includes a table 462; a rotating blade 463 provided on the table 462; a driving member 464 disposed beneath the table 462 which rotates the rotating blade 463.

When the thin laminas N of the cast alloy are supplied to the above-described vertical furnace 451, the inside of the thin lamina-path 452 is filled with the thin laminas N of the cast alloy, and the thin laminas N of the cast alloy are successively pushed out from the thin lamina-path 452. The pushed out thin laminas N of the cast alloy are mounted on the table 462 of the table feeder 461, but they are further pushed out to the circumference of the table 462 when the rotating blade 463 rotates, and they are dropped into the container 305. The thin laminas N of the cast alloy are kept at a predetermined temperature or heated with the outside heater 453 while they pass through the thin lamina-path 452. The temperature-keeping time can be adjusted by controlling the balance between the supplying rate of the thin laminas N of the cast alloy to the vertical furnace 451, and the discharging rate of the thin laminas N of the cast alloy at the table feeder 461.

Thus, according to the heating device shown in FIG. 15, the successively supplied thin laminas N of the cast alloy can be kept at a predetermined temperature or heated, and the period for the temperature-keeping or heating can be also fixed.

Next, another embodiment of the apparatus for producing an alloy is further described, wherein a vibrating feeder equipped with a heater is provided between a casting device and a heating device in order to uniformly keep the temperature of the thin laminas N of the cast alloy directly uniform after crushing. The structure is shown in FIG. 16.

Figure 16:
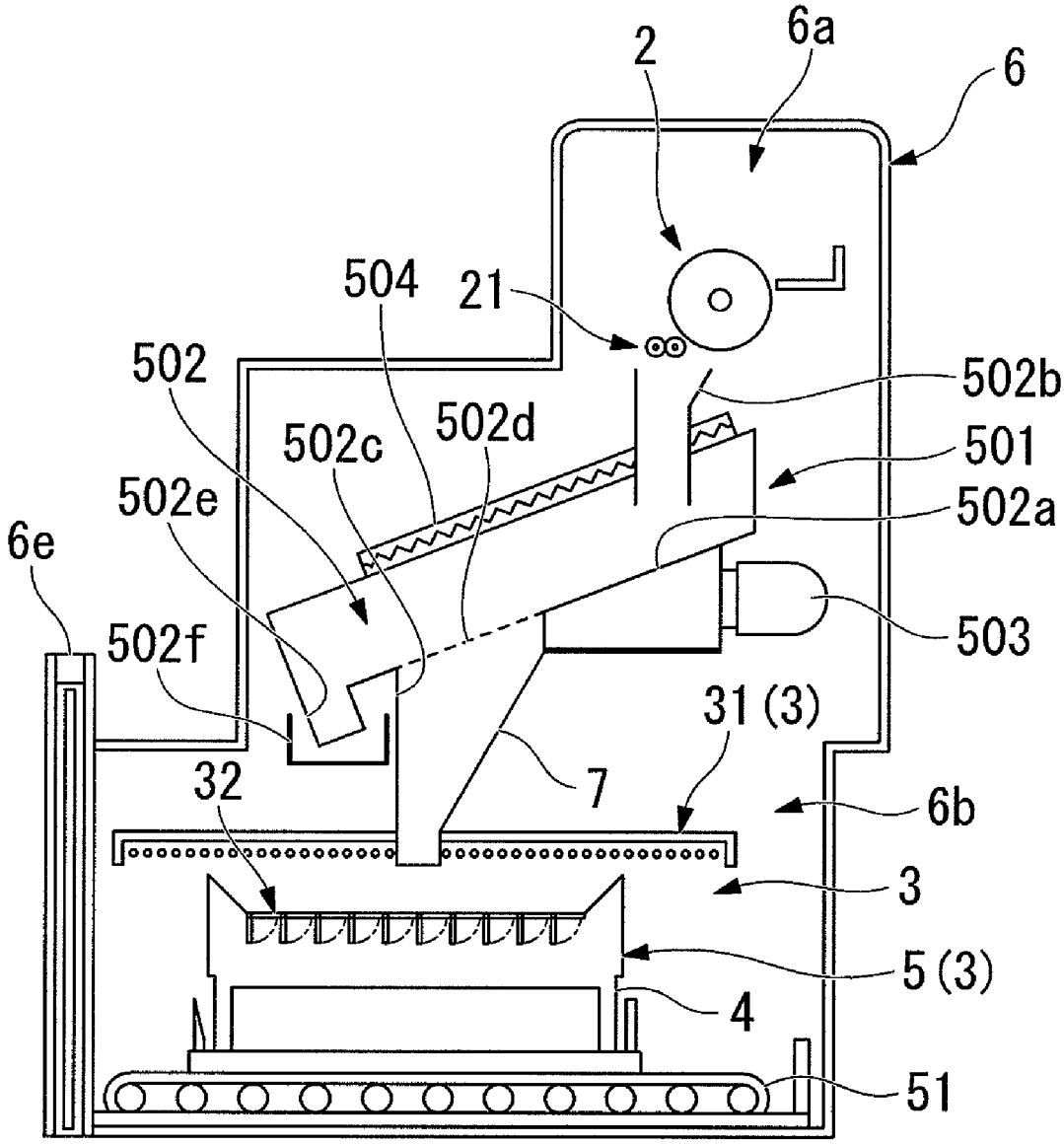
FIG. 16 is a front view showing another embodiment of the apparatus for producing an alloy.

In the production apparatus shown in FIG. 16, a vibrating feeder 501 equipped with a heater is disposed between the casting device and the heating device. In brief, the vibrating feeder 501 equipped with a heater includes a thin lamina-path 502 having an inclined plane 502*a*; a vibration-generating device 503 that vibrates the inclined plane 502*a*; and heater 504 disposed over the thin lamina-path 502.

A hopper 502*b* which is a path-way for the thin laminas of the cast alloy crushed by a crushing device 21 is disposed at the upstream of the thin lamina-path 502. Also, the inclined plane 502*a* has an outlet 502*c* at the downstream of the thin lamina-path 502, and a metal net 502*d* is attached to the outlet 502*c*. A retrieving outlet 502*e* is provided at the downstream from the outlet 502*c* to retrieve the thin laminas of the cast alloy having large particle sizes that could not pass through the metal net 502*d*, and a retrieving plate 502*f* is provided under the retrieving outlet 502*e*.

In addition, projections may be provided on the inclined plane 502*a* to entirely spread the sliding thin laminas of the cast alloy in the cross direction of the inclined plane 502*a*.

When the thin laminas of the cast alloy are supplied to the vibrating feeder 501 equipped with a heater, the thin laminas of the cast alloy slide off on the inclined plane 502*a* which is vibrated by the vibration-generating device 503. Then, the thin laminas of the cast alloy having small particles sizes pass through the metal net 502*d*, and drop from the hopper 7 into the heating device 3. On the other hand, the thin laminas of the cast alloy having large particle sizes further slide down onto the metal net 502*d*, and they are retrieved in the retrieving plate 502*f* from the retrieving outlet 502*e*. The thin laminas of the cast alloy are kept at a predetermined temperature or heated by the heater 504 while they slide down on the thin lamina-path 502. Accordingly, the temperature of the thin laminas of the cast alloy directly after crushing can be made uniform.

In addition, the present invention is limited to the above-described embodiment, and additions, omissions, substitutions, and other modifications can be made without departing from the spirit or scope of the present invention. For example, the configuration of the opening-closing stages 33 is not limited to the above-described embodiment. For example, the opening-closing stages 33 shown in FIG. 11 may be applied.

Figure 17A:
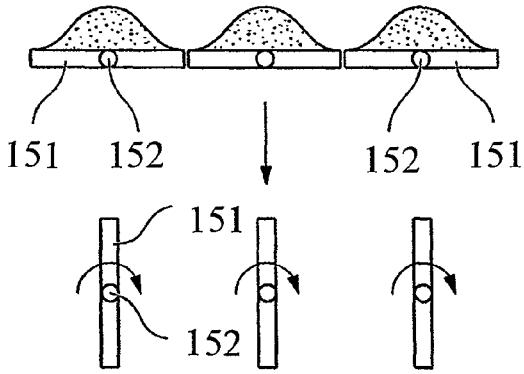
FIG. 17 is a view showing another example of the opening-closing stage.

FIG. 17A shows an embodiment in which a rotating shaft 152 is provided at the center of a stage plate 151. In this embodiment, the motion of opening and closing can be achieved by rotating the rotating shaft 152 in one direction.

Figure 17B:
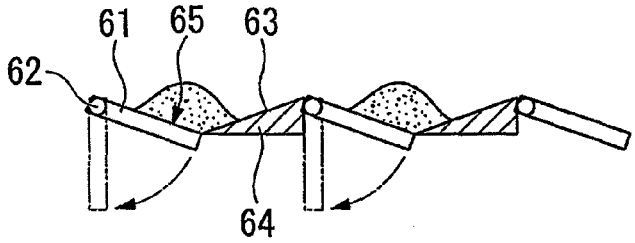

Also, FIG. 17B shows another embodiment in which slightly inclined stage plates 61 having a rotating shaft 62 are provided, and a fixing member 64 having an inclined plane 63 is set to face the stage plate 61 to form an opening-closing stage. In this embodiment, the stage plate 61 is faced to the fixing member 64 to form a groove 65, the thin laminas of the cast alloy are piled in the groove 65, and therefore, thin laminas are prevented from scattering around.

As an example of a driving member for the container 5, a belt conveyor 51 is shown. However, for example, the container 5 may be equipped with a truck having wheels to form a vehicle-type container, and the truck may be designed to run on a railroad which is built in the apparatus.

Furthermore, the following embodiments can be applied instead of installing the cooling plate inside the container.

One example is a storage container wherein a stainless steel net is provided parallel to the bottom of the container so as to form a space between the stainless steel net and the bottom of the container, and an inert cooling gas is injected thereto. In this device, the thin laminas of the cast alloy can be cooled by injecting a cooling gas thereto directly after they are dropped and retrieved therein, and the cooling rate for the thin laminas of the cast alloy can be further modulated by adjusting the volume of the cooling gas injected thereto.

In the above-described example, they are cooled by way of the gas-phase cooling with a gas flowing between the piles. Therefore, if a large amount of the thin laminas of the cast alloy is piled, and the container is large, then the piles also tend to be large, and their cooling rate may be accidentally limited, or they may be ununiformly cooled depending on the position of the container.

Such problems may be solved by applying another example, wherein the inside of the storage container is partitioned with a plurality of hollow partition panels, a cooling medium flows inside the hollow partition panels, and the cooling rate of the thin laminas of the cast alloy can be sped up by way of the contact cooling between the hollow partition panels and the thin laminas of the cast alloy. According to this technique, the cooling medium does not have direct contact with the thin laminas of the cast alloy. Therefore, a gas such as air other than inert gases, or a liquid such as water can be used as a cooling medium.

Yet another embodiment can be mentioned. This embodiment utilizes the technique in which vent holes are made at the bottom parts of the above-described hollow partition panels, and a part of the inert gas that is injected into the panels is released from the vent holes to the inside of the storage container to cool the thin laminas of the cast alloy. In general, it is effective to cool the thin laminas of the cast alloy as rapidly as possible with regard to cooling after the internal structures of the alloy are solidified. In particular, such rapid cooling is preferable when casting is continuously conducted.

Another heater can be provided on the down side of the stage plate 33*a* of the opening-closing stage 33, and the stage plate 33*a* may be heated by this heater. This heater may be used in combination with the heater 31. In addition, this embodiment may be applied to the above-described heating device 103 or 203.

Also, a heat-insulated structure may be provided on the down side of the stage plate 33*a* of the opening-closing stage 33 in order to prevent the heat generated from the heater 31 from transmitting to the inside of the container 5. In this case, as examples of such a heat-insulated structure, blocks or fibrous boards made of ceramics such as alumina and zirconia may be disposed on the down side of the stage plate 33*a*, or a plurality of thin metal plates are piled on the down side of the stage plate 33*a* while having a space between them. With regard to the materials for the thin metal plate, those having a melting temperature lower than the temperature of the thin laminas of the cast alloy can be used, and iron or stainless steel, for example, may be used. In addition, this embodiment can be applied to the above-described heating device 103 or 203.

Also, a heater may be provided in hopper 7 to prevent the thin laminas of the cast alloy from being cooled.

Also, the production apparatuses of the present invention can be applied to produce a thermoelectric semiconductor alloy or hydrogen absorbing alloy other than R-T-B type alloy.

The thermoelectric semiconductor alloys, for example, include alloys represented by the general formula $A_{3-x}B_xC$ (wherein A and B represent at least one element of transition metals such as Fe, Co, Ni, Ti, V, Cr, Zr, Hf, Nb, Mo, Ta and W; and C represents at least one element of Group 13 or 14 such as Al, Ga, In, Si, Ge, and Sn).

Also, the thermoelectric semiconductor alloys can includes, for example, alloys represented by the general formula ABC (A and B represent at least one element of transition metals such as Fe, Co, Ni, Ti, V, Cr, Zr, Hf, Nb, Mo, Ta and W; and C represents at least one element of Group 13 or 14 such as Al, Ga, In, Si, Ge, and Sn).

Moreover, rare earth alloys represented by the general formula $RE_x(Fe_{1-y}M_y)_4Sb_{12}$ (wherein RE represents at least one element of La and Ce; and M represents at least one element selected from the group consisting of Ti, Zr, Sn, and Pb where $0<x\leqq 1$ and $0<y<1$) can be also mentioned.

Furthermore, rare earth alloys represented by the general formula $RE_x(Co_{1-y}M_y)_4Sb_{12}$ (wherein RE represents at least one element of La and Ce; and M represents at least one element selected from the group consisting of Ti, Zr, Sn, Cu, Zn, Mn and Pb where $0<x\leqq 1$ and $0<y<1$) can be also mentioned.

As examples of the hydrogen absorbing alloy, $AB_2$-type alloys (those using a base material of a transition element alloy such as Ti, Mn, Zr and Ni) or $AB_5$-type alloys (those using a base material of an alloy containing 5 parts of a catalytic transition element (Ni, Co, Al or the like) with respect to 1 part of a rare earth element, Nb, and/or Zr) can be mentioned.

EXAMPLES

The material mixture of neodymium metal, dysprosium metal, ferroboron, cobalt, aluminum, copper, and iron (where the alloy composition ratio becomes 22% of Nd, 9.5% of Dy, 0.96% of B, 1.0% of Co, 10.15% of Al, 0.10% of Cu, and the balance being Fe) was molten in the atmosphere of an argon gas at 1 atm pressure in the high-frequency melting furnace using an alumina crucible in order to prepare a molten alloy.

Then, this molten alloy was supplied to the casting device of the production apparatus shown in FIG. 1, this was cast by way of the SC method, and crushed to produce thin laminas of the cast alloy.

In addition, the diameter of the cooling roll was 600 mm, the material of the cooling roll was an alloy in which a small amount of Cr and Zr is mixed with copper. The inside of the cooling roll was water-cooled, and the circumferential speed of the roll was 1.3 m/s when casting. The average temperature of the cast alloy M when separating from the cooling roll was measured with a radiation thermometer, and it was found 890° C. Furthermore, with regards to the measured values, the difference between the maximum temperature and the minimum temperature was 35° C. The melting temperature of the $R_2T_{14}B$-phase of the produced alloy was about 1170° C. Therefore, the difference between the melting temperature and the average temperature was 280° C. In addition, the average cooling rate of the blocks of the cast alloy on the cooling roll was 980° C./second, and the average thickness was 0.29 mm.

The produced thin laminas of the cast alloy were allowed to pass through the hopper 7 of the production apparatus shown in FIG. 1, and they were piled on the opening-closing stages. Then, they were subjected to the temperature-keeping treatment where they were kept at 700° C. to 900° C. for one minute (700° C. in Example 1; 800° C. in Example 2; and 900° C. in Example 3). In this way, thin laminas of the cast alloy formed by Examples 1 to 3 that were formed of the rare earth alloys were prepared.

On the other hand, thin laminas of the cast alloy of Comparative Example 1 were produced in the same manner as Examples 1 to 3 except that the temperature-keeping treatment was not conducted.

Then, each of thin laminas of the cast alloy was pressed with a molding machine in an atmosphere of 100% nitrogen and in the transverse magnetic field. The molding pressure was set 0.8 t/cm$^2$ and the magnetic field of 15 kOe was generated in the mold cavity. The obtained compact was kept in a vacuum of $1.33\times10^{-5}$ hPa at 500° C. for one hour, then kept in a vacuum of $1.33\times10^{-5}$ hPa at 800° C. for two hours, and further kept in a vacuum of $1.33\times10^{-5}$ hPa at 1030° C. for two hours whereby the compact was sintered. Their sintered densities ranged from 7.67 to 7.69 g/cm$^3$ or more, and they had sufficient densities. These sintered products were further heated in an atmosphere of argon at 530° C. for one hour whereby R-T-B type magnets of Examples 1 to 3 and Comparative Example 1 were produced.

Figure 18:
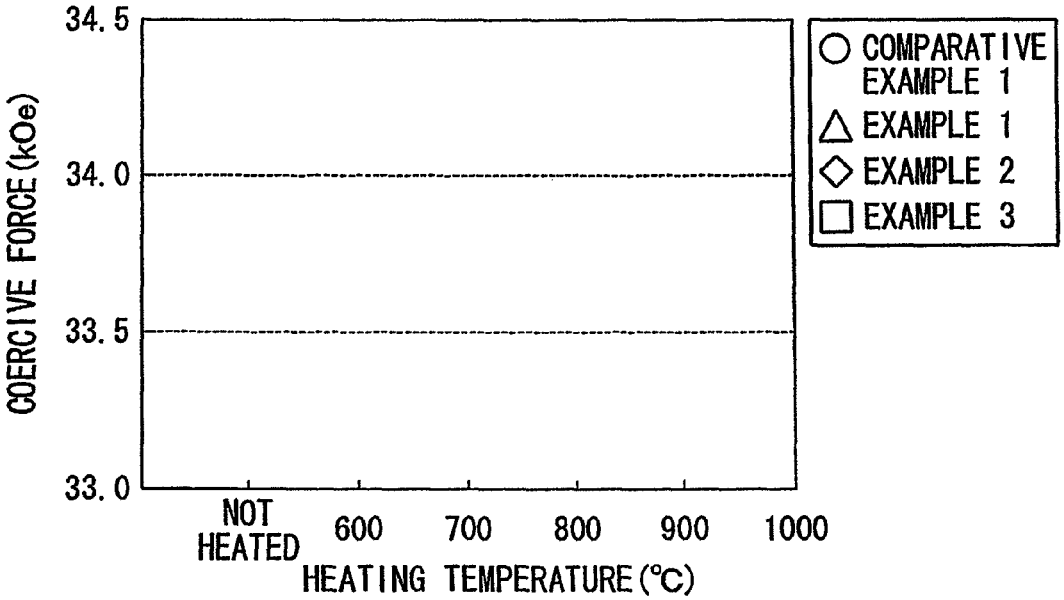
FIG. 18 is a graph describing the relationship between the keeping temperature and the coercive force of the R-T-B type magnets produced in Examples 1 to 3 and Comparative Example 1.

The magnetic properties of the obtained R-T-B type magnets were measured with a pulse-type B-H curve tracer. The result is shown in FIG. 18. FIG. 18 shows a relationship between the temperature for the temperature-keeping treatment, and the coercive force of the R-T-B type magnets with respect to Examples 1 to 3 and Comparative Examples 1.

As shown in FIG. 18, it was revealed that the coercive forces of the R-T-B type magnets of Examples 1 to 3 that were subjected to the temperature-keeping treatment were improved by about 3% with respect to Comparative Example 1 that was not subjected to the temperature-keeping treatment.

INDUSTRIAL APPLICABILITY

According to the present invention, the apparatus for producing an alloy can produce an R-T-B type magnet having high coercive force as well as reducing the cost with regard to the material used therein. The produced R-T-B type magnets can be applied to industrial products such as hard disks, MRI apparatuses and motors. Furthermore, the production apparatus of the present invention can be applied to the production of a thermoelectric semiconductor alloy or hydrogen absorbing alloy other than the R-T-B type alloy. Therefore, the apparatus for producing an alloy of the present invention has high industrial applicability.

The invention claimed is:

1. An apparatus for producing an alloy, comprising:

a casting device which casts a molten alloy using a strip cast method;

a crushing device which crushes a cast alloy after casting; and a heating device which keeps thin laminas of the cast alloy after crushing at a predetermined temperature, or which heats the thin laminas of the cast alloy after crushing, wherein the heating device is equipped with a container and a heater;

a hopper and the heating device are disposed below the crushing device;

the heater has an opening part, and an outlet of the hopper is disposed in the opening part;

the container is equipped with a storage container, and an opening-closing stage disposed over the storage container;

the thin laminas of the cast alloy supplied from the crushing device are mounted on the opening-closing stage when the opening-closing stage is in a closed state; and the opening-closing stage releases the thin laminas of the cast alloy to the storage container when the opening-closing stage is in an opened state.

2. The apparatus for producing an alloy according to claim 1, wherein the opening-closing stage releases the thin laminas of the cast alloy to the storage container after a predetermined period from the time when the thin laminas of the cast alloy are mounted on the opening-closing stage.

3. The apparatus for producing an alloy according to claim 2, wherein the heater keeps the thin laminas of the cast alloy mounted on the opening-closing stage at a predetermined temperature, or the heater heats the thin laminas of the cast alloy mounted on the opening-closing stage.

4. The apparatus for producing an alloy according to claim 3, further comprising a driving device which enables the container to move freely.

5. The apparatus for producing an alloy according to claim 4, wherein the container is equipped with a plurality of the opening-closing stages, and the plurality of the opening-closing stages is disposed along the moving direction of the container.

6. The apparatus for producing an alloy according to claim 5, wherein the thin laminas of the cast alloy are sequentially mounted on each opening-closing stage by moving the container in accordance with preparation of the thin laminas of the cast alloy.

7. The apparatus for producing an alloy according to claim 6, wherein the opening-closing stages sequentially release the thin laminas of the cast alloy to the storage container after a predetermined period from the time when the thin laminas of the cast alloy are mounted on the opening-closing stages.

8. The apparatus for producing an alloy according to claim 5, wherein the opening-closing stages sequentially release the thin laminas of the cast alloy to the storage container after a predetermined period from the time when the thin laminas of the cast alloy are mounted on the opening-closing stages.

9. The apparatus for producing an alloy according to claim 8, wherein the opening-closing stage includes a stage plate, and an opening-closing system which opens and closes the stage plate while the opening-closing system controls the inclining angle of the stage plate; the opening-closing system mounts the thin laminas of the cast alloy on the stage plate by adjusting the stage plate at a horizontal position or a inclining position when the opening-closing stage is in a closed state; and the opening-closing system releases the thin laminas of the cast alloy to the storage container by making the inclining angle of the stage plate larger when the opening-closing stage is in an open state.

10. The apparatus for producing an alloy according to claim 9, wherein the opening-closing stage releases the thin laminas of the cast alloy to the storage container by making the inclining angle of the stage plate larger after a predetermined period from the time when the thin laminas of the cast alloy are mounted on the stage plate.

11. The apparatus for producing an alloy according to claim 10, wherein the heater is disposed between the crushing device and the opening-closing stages along the moving direction of the container.

12. The apparatus for producing an alloy according to claim 1, wherein a belt conveyor or a pushing device is disposed between the heater and the container.

13. The apparatus for producing an alloy according to claim 1, wherein the casting device, the crushing device, and the heater are disposed inside a chamber of an inert gas atmosphere.

14. The apparatus for producing an alloy according to claim 13, wherein a cooling chamber is provided inside the chamber, and the container is able to move to the cooling chamber.

15. The apparatus for producing an alloy according to claim 1, wherein the alloy is a rare earth element-containing alloy.

16. The apparatus for producing an alloy according to claim 15, wherein the rare earth element-containing alloy comprises an R-T-B type alloy where R is at least one element of rare earth elements including Y; T is a metal which indispensably contains Fe; and B is boron.

17. The apparatus for producing an alloy according to claim 1, wherein the alloy is a hydrogen absorbing alloy.

18. The apparatus for producing an alloy according to claim 1, wherein the alloy is a thermoelectric semiconductor alloy.

* * * * *